US010968693B2

(12) United States Patent
Stout et al.

(10) Patent No.: US 10,968,693 B2
(45) Date of Patent: Apr. 6, 2021

(54) VALANCE ASSEMBLY FOR A COVERING AND ASSOCIATED PACKAGING

(71) Applicant: Hunter Douglas Industries Switzerland GmbH, Lucerne (CH)

(72) Inventors: Jeffrey Stout, Sandy Springs, GA (US); Ajit Singh, Duluth, GA (US); Alberto Gonzalez, Atlanta, GA (US); Ronnie Sullivan, Kennesaw, GA (US); Ryan Peters, Atlanta, GA (US); Stephen Jones, Sandy Springs, GA (US); Maureen Carroll, Atlanta, GA (US)

(73) Assignee: HUNTER DOUGLAS INDUSTRIES SWITZERLAND GMBH, Lucerne (CH)

( * ) Notice: Subject to any disclaimer, the term of this patent is extended or adjusted under 35 U.S.C. 154(b) by 307 days.

(21) Appl. No.: 15/968,903

(22) Filed: May 2, 2018

(65) Prior Publication Data

US 2018/0328107 A1 Nov. 15, 2018

Related U.S. Application Data

(60) Provisional application No. 62/506,096, filed on May 15, 2017.

(51) Int. Cl.
*A47H 2/00* (2006.01)
*E06B 9/323* (2006.01)

(52) U.S. Cl.
CPC ..... *E06B 9/323* (2013.01); *A47H 2/00* (2013.01)

(58) Field of Classification Search
CPC ..... E06B 9/323; E06B 9/17; E06B 9/17007; E06B 9/17015; A47H 2/00; A47H 2/02; A47H 1/04; A47H 1/144; A47H 1/14; A47H 2001/047
See application file for complete search history.

(56) References Cited

U.S. PATENT DOCUMENTS

| | | | | |
|---|---|---|---|---|
| 224,466 | A | 2/1880 | Murphey | |
| 3,481,092 | A * | 12/1969 | Constantino | E04F 19/0436 52/287.1 |
| 4,222,427 | A * | 9/1980 | Buchner | A47H 2/00 16/94 R |
| 5,042,548 | A | 8/1991 | Attal | |
| 5,259,687 | A | 11/1993 | John | |
| 5,383,508 | A | 1/1995 | Pavlica et al. | |
| 5,515,901 | A | 5/1996 | Hall | |
| 5,803,144 | A * | 9/1998 | Ives | A47H 19/00 160/38 |

(Continued)

FOREIGN PATENT DOCUMENTS

WO WO 96/02175 2/1996

*Primary Examiner* — Johnnie A. Shablack
*Assistant Examiner* — Jeremy C Ramsey
(74) *Attorney, Agent, or Firm* — Dority & Manning, P.A.

(57) ABSTRACT

A multi-piece valance body is configured to extend lengthwise along the front of an adjacent headrail (e.g., of a covering for an architectural opening) between opposed lateral ends. The valance body may include a first valance body portion and a second valance body portion, with the body portions configured to be coupled together via a joint defined between the body portions in the lengthwise direction across the length of the headrail (e.g., a width of the architectural opening) to form the complete valance body structure.

21 Claims, 17 Drawing Sheets

(56) References Cited

U.S. PATENT DOCUMENTS

| | | | | |
|---|---|---|---|---|
| 5,944,084 | A * | 8/1999 | Cadorette | A47H 2/00 160/19 |
| 7,168,474 | B2 | 1/2007 | Lam | |
| 7,441,582 | B2 * | 10/2008 | Lukos | E04F 10/0662 160/23.1 |
| 7,513,290 | B2 | 4/2009 | Repp et al. | |
| 7,575,035 | B2 | 8/2009 | Lee | |
| 2006/0272239 | A1 | 12/2006 | Lam | |
| 2007/0034341 | A1 | 2/2007 | Lam | |
| 2015/0300079 | A1 * | 10/2015 | Dallan | F16B 2/10 248/266 |
| 2017/0208980 | A1 * | 7/2017 | Mullet | A47H 2/00 |

* cited by examiner

VALANCE ASSEMBLY FOR A COVERING AND ASSOCIATED PACKAGING

FIELD OF THE INVENTION

This application is based upon and claims the right of priority of U.S. Provisional Patent Application No. 62/506,096, filed May 15, 2017, the disclosure of which is hereby incorporated by reference herein in its entirety for all purposes.

FIELD OF THE INVENTION

The present subject matter relates generally to valances configured for use with coverings for architectural structures and, more particularly, to a multi-piece valance assembly that allows for a desired valance height to be achieved while still providing for efficient packaging of the valance and associated covering and/or efficient cutting of the valance/covering within the associated package.

BACKGROUND OF THE INVENTION

In many instances, a valance is coupled to the front of a headrail of a window covering to improve the overall aesthetic appearance of the window covering. For example, valances often have a unique shape or outer profile that provides a more aesthetically pleasing look than the front of the headrail, itself. As is generally understood, a valance may be secured to and supported by an associated headrail using a variety of different techniques, such as by using valance clips coupled between the headrail and the valance.

When designing a valance to be used in association with a headrail, it is often desirable to provide the valance with a given vertical height. For instance, due to the vertical height of the associated headrail, a minimum vertical height may be desired to ensure that the valance adequately covers the front of the headrail. Additionally, in certain instances, it may be desirable to provide a valance with an increased vertical height notwithstanding the corresponding vertical height of the headrail. For instance, valances with increased heights may provide a unique aesthetic appearance that cannot be achieved with shorter valances.

Despite the desirability in many instances to provide valances with increased vertical heights, conventional design constraints and other considerations often serve to limit the height of a valance. For instance, window coverings sold in retail stores are often packaged in standardized boxes. In such instances, these standardized boxes typically provide a pre-defined storage area for the associated valance, which serves to limit the overall size of the valance. Moreover, the packaging for retail window coverings may be specifically designed to allow the covering and associated valance to be cut or sized within its package via a cut-down machine (also referred to a size-in-store machine) located at the associated retail establishment. As a result, the location or relative positioning of the valance within the package is typically set based on the cutting configuration of the cut-down machine so as to ensure prospering sizing or trimming of the covering/valance. In addition, the maximum dimensions for the packaging may also be limited based on the cutting configuration of the cut-down machine. Furthermore, packaging dimensions must also take into account shipping constraints and/or the amount of shelf space to be occupied within a retail store. Accordingly, such packaging/processing constraints typically serve as practical limits on the overall height of a valance.

Accordingly, a multi-piece valance assembly that allows for the assembled valance to have a desired vertical height while taking into consideration relevant packaging/processing constraints would be welcomed in the technology.

BRIEF DESCRIPTION OF THE INVENTION

Aspects and advantages of the present subject matter will be set forth in part in the following description, or may be obvious from the description, or may be learned through practice of the present subject matter.

In various aspects, the present subject matter is directed to a valance assembly configured for use with a covering for an architectural structure. In several embodiments, the valance assembly may include a multi-piece valance body configured to extend lengthwise along the front of an adjacent headrail between opposed lateral ends. For instance, the valance body may include a first valance body portion and a second valance body portion, with the body portions configured to be coupled together via a joint defined between the body portions to form the complete valance body structure. As such, the first and second body portions may allow for the valance body to define a desirable overall height when in an assembled state and may also be configured to be disassembled to allow for efficient packaging/processing of the multi-piece valance body.

These and other features, aspects and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE INVENTION

Figure 1:
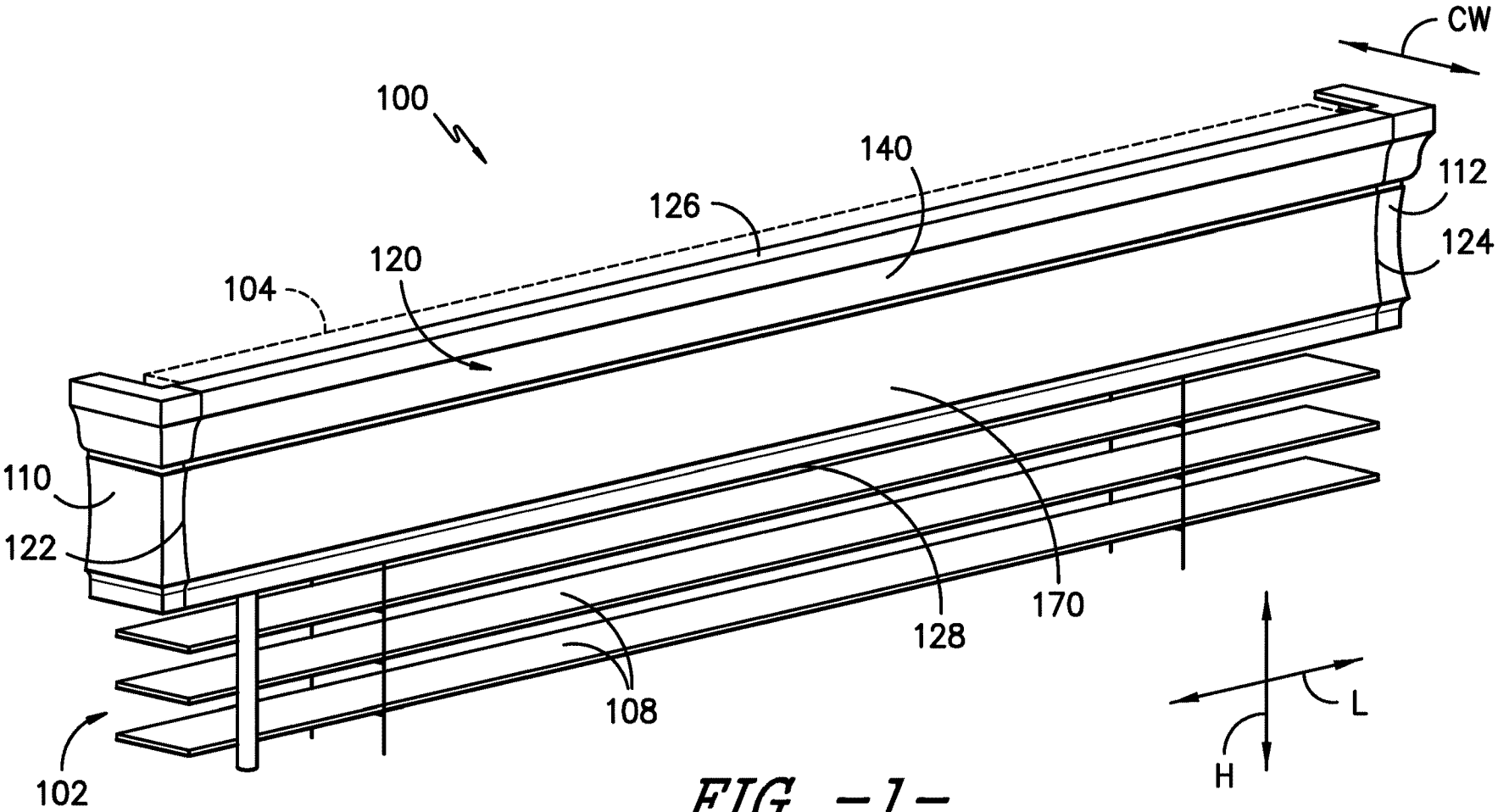
FIG. 1 illustrates a perspective view of one embodiment of a valance assembly installed relative to a covering for an architectural structure in accordance with aspects of the present subject matter.

In general, the present subject matter is directed to a valance assembly configured to be installed relative to a headrail of a covering for an architectural feature or structure (referred to herein simply as an architectural "structure" for the sake of convenience and without intent to limit). Specifically, in several embodiments, the valance assembly may include a valance body configured to extend longitudinally in a lengthwise direction between opposed lateral ends of the body along a corresponding length of the headrail. In such embodiments, the valance body may be configured to cover or substantially cover the front of the adjacent headrail between its opposed lateral ends.

Additionally, in several embodiments, the valance body may correspond to a multi-piece construction including two or more separate valance body portions configured to be assembled together form a complete or substantially complete valance body structure. For example, in one embodiment, the valance body may correspond to a two-piece construction including a first valance body portion and a second valance body portion, with the first and second valance body portions configured to be assembled together at a joint defined between the body portions. For example, the joint may be defined between the body portions in the lengthwise direction of the valance body such that the joint extends longitudinally between the opposed lateral ends of the valance body (i.e., along the length of the adjacent headrail).

In one embodiment, the joint defined between the first and second valance body portions may be configured to substantially limit or constrain relative linear motion between the body portions in two or more directions while still allowing relative motion between the body portions in at least one direction to permit assembly and disassembly of the valance body. For example, the joint may be configured to substantially constrain relative linear motion between the body portions in both a heightwise direction and cross-wise direction of the valance body. In such an embodiment, the joint may be configured to allow relative motion between the valance body portions along the lengthwise direction of the valance body, thereby facilitating assembly and disassembly of the valance body by sliding or moving the valance body portions relative to each other in the lengthwise direction. Moreover, in one embodiment, the joint may also be configured to limit relative rotational motion between the body portions in one or more directions, such as by substantially constraining relative rotational motion along a rotational axis extending parallel to the lengthwise direction of the valance body.

Additionally, in one embodiment, the valance body may define an overall height in the heightwise direction that is greater than the individual heights of the first and second valance body portions. As a result, when disassembled, the heightwise profile of the valance body portions may be smaller than the overall height of the assembled valance body, thereby eliminating the need to specifically design the packaging for the disclosed valance assembly and associated covering to accommodate the overall height of the valance body. Rather, the valance body may be packaged in its disassembled state, with the first and second valance body portions being positioned relative to each other in an overlapping or nesting configuration so as to minimize the heightwise profile of the assembly within the packaging. Accordingly, such a configuration may allow for the dimensions of the packaging to be defined as a function of the other controlling dimensions of the valance assembly and/or the associated covering, thereby permitting the packaged valance assembly/covering to satisfy conventional packaging constraints and/or other design considerations, such as applicable size constraints related to shipping and/or shelf storage space.

Moreover, by configuring the valance body to be disassembled for packaging, the valance body portions may be positioned within the packaging relative to each other and relative to the associated covering to allow both the valance body portions and the covering to be sized or cut within the packaging via a cut-down or size-in-store (SIS) machine. For example, the valance body portions may be positioned within the packaging in their overlapping or nesting configuration such that the heightwise direction of each body portion is generally oriented perpendicular to the holding direction and/or the cutting direction for the associated SIS machine, thereby allowing for a clean, efficient cut to be made across the valance body portions and the covering contained within the packaging. Moreover, the packaging configuration of the disclosed valance assembly may allow for the packaged valance assembly and associated covering to satisfy the size constraints often imposed for cutting such packaged components using conventional SIS machines (e.g., maximum package dimensions).

Further, in one embodiment, the valance assembly may also include endcaps configured to be coupled to the opposed lateral ends of the valance body. In such an embodiment, each endcap may be coupled to a corresponding lateral end of the assembled valance body using any suitable attachment structure and/or means. For instance, in one embodiment, the endcaps may include one or more retention or engagement features, such as one or more projections or other features/members, configured to engage or interlock with the joint structure defined between the first and second valance body portions.

In one aspect, a valance assembly is configured to be installed relative to a headrail of a covering for an architectural structure such that the valance assembly extends in a lengthwise direction along a length of the headrail. The valance assembly includes a valance body extending longitudinally in the lengthwise direction between a first lateral end and a second lateral end and in a heightwise direction between a first valance end and a second valance end. The valance body defines an overall height in the heightwise direction between the first and second valance ends. In addition, the valance body includes first and second valance body portions. The first valance body portion extends in the lengthwise direction between the first and second lateral ends of the valance body and in the heightwise direction between the first valance end of the valance body and an opposed first joint end. The first valance body portion also defines a joint slot at or adjacent to the first joint end. The second valance body portion extends in the lengthwise direction between the first and second lateral ends of the valance body and in the heightwise direction between the second valance end of the valance body and an opposed second joint end. When the first and second valance body portions are assembled relative to each other at the first and second joint ends, a joint is defined between the first and second body portions that extends longitudinally in the lengthwise direction between the first and second lateral ends of the valance body.

In one embodiment, the first valance body portion extends in a cross-wise direction perpendicular to the heightwise and lengthwise directions between a first front side and a first rear side, and the second valance body portion extends in the cross-wise direction between a second front side and a second rear side. In such an embodiment, when the first valance body portion is assembled relative to the second body portion, the first and second front sides of the first and second valance body portions together define a front face of the valance body and the first and second rear sides of the first and second valance body portions together define a rear face of the valance body.

In one embodiment, the joint defined between the first and second body portions is configured to substantially constrain relative motion between the first and second joint ends of the first and second valance body portions in both the heightwise direction and a cross-wise direction extending perpendicular to the heightwise and lengthwise directions. Additionally, in one embodiment, the joint is configured to substantially constrain relative rotational motion between the first and second joint ends of the first and second body portions along a rotational axis extending parallel to the lengthwise direction.

In one embodiment, the first valance body portion defines a first height in the heightwise direction between the first valance end of the valance body and the first joint end, and the second valance body portion defines a second height in the heightwise direction between the second valance end of the valance body and the second joint end. In one embodiment, the first and second heights are less than the overall height of the valance body. Additionally, in one embodiment, the overall height of the valance body is less than a summation of the first and second heights. Moreover, in one embodiment, the first valance end of the valance body defines a top end of the valance body, and the second valance end of the valance body defines a bottom end of the valance body.

In one embodiment, the first valance body portion defines a joint slot at or adjacent to its first joint end, and the second valance body portion includes a projection at or adjacent to its second joint end that is configured to be received within the joint slot. In such an embodiment, when the first valance body portion is assembled relative to the second body portion such that the projection is received within the joint slot, the joint is defined between the first and second body portions. Additionally, in one embodiment, an end portion of the projection is configured to be received within the joint slot at one of the first lateral end or the second lateral end of the valance body. In such an embodiment, the first and second valance body portions are configured to be moved relative to one each other in the lengthwise direction such that a relative position of the end portion of the projection is moved within the joint slot towards the other of the first lateral end or the second lateral end of the valance body. Moreover, in one embodiment, the joint slot defines a dovetail shape.

In one embodiment, the joint slot is defined by first and second angled wall sections of the first body portion that extend outwardly from a base wall section of the joint slot. In one embodiment, the first and second angled wall sections are angled towards each other such that the joint slot defines a converging profile as the joint slot extends outwardly from the base wall section. Additionally, in one embodiment, the projection includes at least one angled projection defining a complementary profile to the joint slot such that the at least one angled projection extends adjacent to at least one of the first angled wall section or the second angled wall section when the at least one angled projection is received within the joint slot.

In one embodiment, the projection includes a first angled projection and a second angled projection. In one embodiment, an outer surface of the first angled projection defines a first diverging profile that is complementary to the converging profile of the joint slot such that the first angled projection extends adjacent to the first angled wall section when the first angled projection is received within the joint slot, and an outer surface of the second angled projection defines a second diverging profile that is complementary to the converging profile of the joint slot such that the second angled projection extends adjacent to the second angled wall section when the second angled projection is received within the joint slot. Additionally, in one embodiment, the first and second angled projections are spaced apart from each other in the heightwise direction such that an insertion slot is defined between the first and second angled projections. Moreover, in one embodiment, the valance assembly further includes an endcap configured to be coupled to one of the first lateral end or the second lateral end of the valance body, with the endcap including a post configured to be received within the insertion slot when the endcap is coupled to the one of the first lateral end or the second lateral end.

In one embodiment, the second body portion defines a second joint slot at or adjacent to its second joint end. In such an embodiment, the first body portion includes a second projection configured to be received within the second joint slot when the first and second body portions are assembled together.

In one embodiment, the first and second body portions define complementary heightwise profiles such that the first and second body portions are configured to nest relative to each other when the valance body is disassembled and the complementary heightwise profiles are positioned adjacent to each other.

In another aspect, a valance assembly is configured to be installed relative to a headrail of a covering for an architectural structure such that the valance assembly extends in a lengthwise direction along a length of the headrail. The valance assembly includes a valance body extending longitudinally in the lengthwise direction between a first lateral end and a second lateral end and in a heightwise direction between a top end and a bottom end. In addition, the valance body includes first and second valance body portions. The first valance body portion extends in the lengthwise direction between the first and second lateral ends of the valance body and in the heightwise direction between the top end of the valance body and an opposed first joint end. The first valance body portion defines a first height in the heightwise direction. The second valance body portion extends in the lengthwise direction between the first and second lateral ends of the valance body and in the heightwise direction between the bottom end of the valance body and an opposed second joint end. The second valance body portion defines a second height in the heightwise direction. When the first valance body portion is assembled relative to the second valance body portion at a joint defined between the first and second body portions, the valance body defines an overall height in the heightwise direction between the top and bottom ends that is greater than the individual first and second heights of the first and second valance body portions.

In a further aspect, the present subject matter is directed to a packaged covering and valance assembly. The assembly includes a package defining a storage area, with the storage area defining an overall width in a first packaging direction between opposed first and second endwalls of the package and an overall height in a second packaging direction between opposed first and second sidewalls of the package. The overall width of the package is greater than the overall height of the package. The assembly also includes a covering positioned within a first portion of the storage area, and a multi-piece valance body positioned within a second portion of the storage area in a disassembled state. The multi-piece valance body includes a first valance body portion and a second valance body portion. The first valance body portion extends in a heightwise direction between a first joint end and an opposed first valance end. The second valance body portion extends in the heightwise direction between a second joint end and an opposed second valance end. The first and second valance body portions are configured to be coupled to each other at the first and second joint ends when assembling the multi-piece valance body. Additionally, the first and second body portions are oriented within the second portion of the storage area such that each of the first and second body portions extends in the heightwise direction generally parallel to the second packaging direction of the package.

In one embodiment, the first and second body portions are positioned side-by-side within the second portion of the storage area. Additionally, in one embodiment, the first body portion defines a first height in the heightwise direction between the first joint end and the first valance end of the first body portion, and the second body portion defines a second height in the heightwise direction between the second joint end and the second valance end of the second body portion. In one embodiment, both of the first and second heights are less than the overall height of the storage area. Moreover, in one embodiment, when the first and second valance body portions are coupled to each other at the first and second joint ends to assemble the multi-piece valance body, the multi-piece valance assembly is configured to define an overall height that is greater than the overall height of the storage area.

In one embodiment, the first and second portions of the storage area are at least partially separated from each other by an internal dividing wall of the package. Additionally, in one embodiment, the covering includes a headrail, a bottom rail, and a covering assembly extending between the headrail and the bottom rail. The covering is oriented within the package such that the headrail is spaced apart from the bottom rail in the first packaging direction of the package.

In yet another aspect, the present subject matter is directed to a packaged covering and valance assembly. The assembly includes a package defining a storage area, with the storage area defining an overall width in a first packaging direction between opposed first and second endwalls of the package and an overall height in a second packaging direction between opposed first and second sidewalls of the package. The overall width of the package is greater than the overall height of the package. The assembly also includes a covering positioned within a first portion of the storage area, and a multi-piece valance body positioned within a second portion of the storage area in a disassembled state. The multi-piece valance body includes a first valance body portion and a second valance body portion. The first valance body portion extends in a heightwise direction between a first joint end and an opposed first valance end. The second valance body portion extends in the heightwise direction between a second joint end and an opposed second valance end. The first and second valance body portions are configured to be coupled to each other at the first and second joint ends when assembling the multi-piece valance body. Additionally, the first and second body portions are positioned relative to each other within the second portion of the storage area such that the first and second body portions extend in the heightwise direction a heightwise distance that is less than the overall height of the package.

Figure 2:
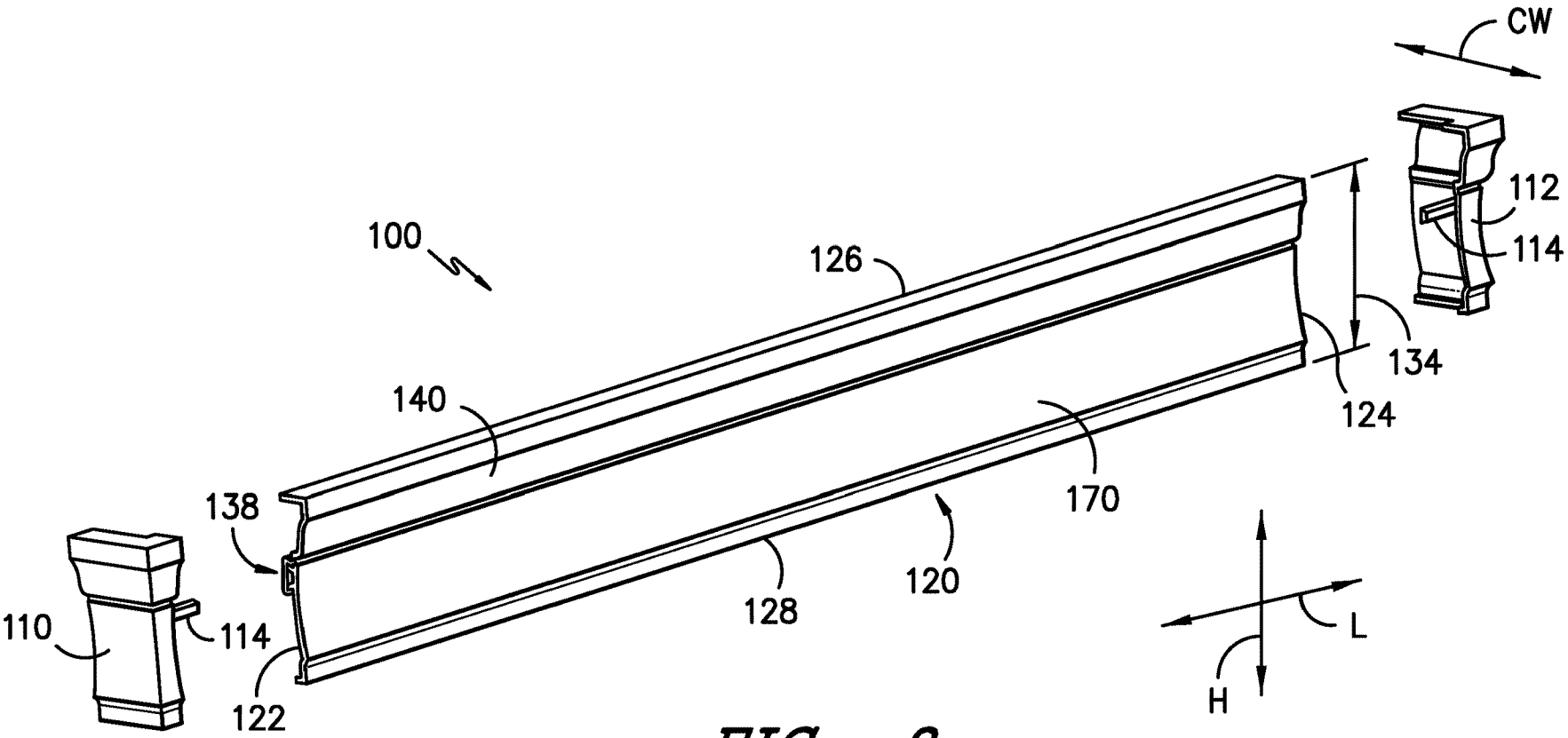
FIG. 2 illustrates another perspective view of the valance assembly shown in FIG. 1, particularly illustrating endcaps of the valance assembly exploded away from a corresponding valance body of the valance assembly.
Figure 3:
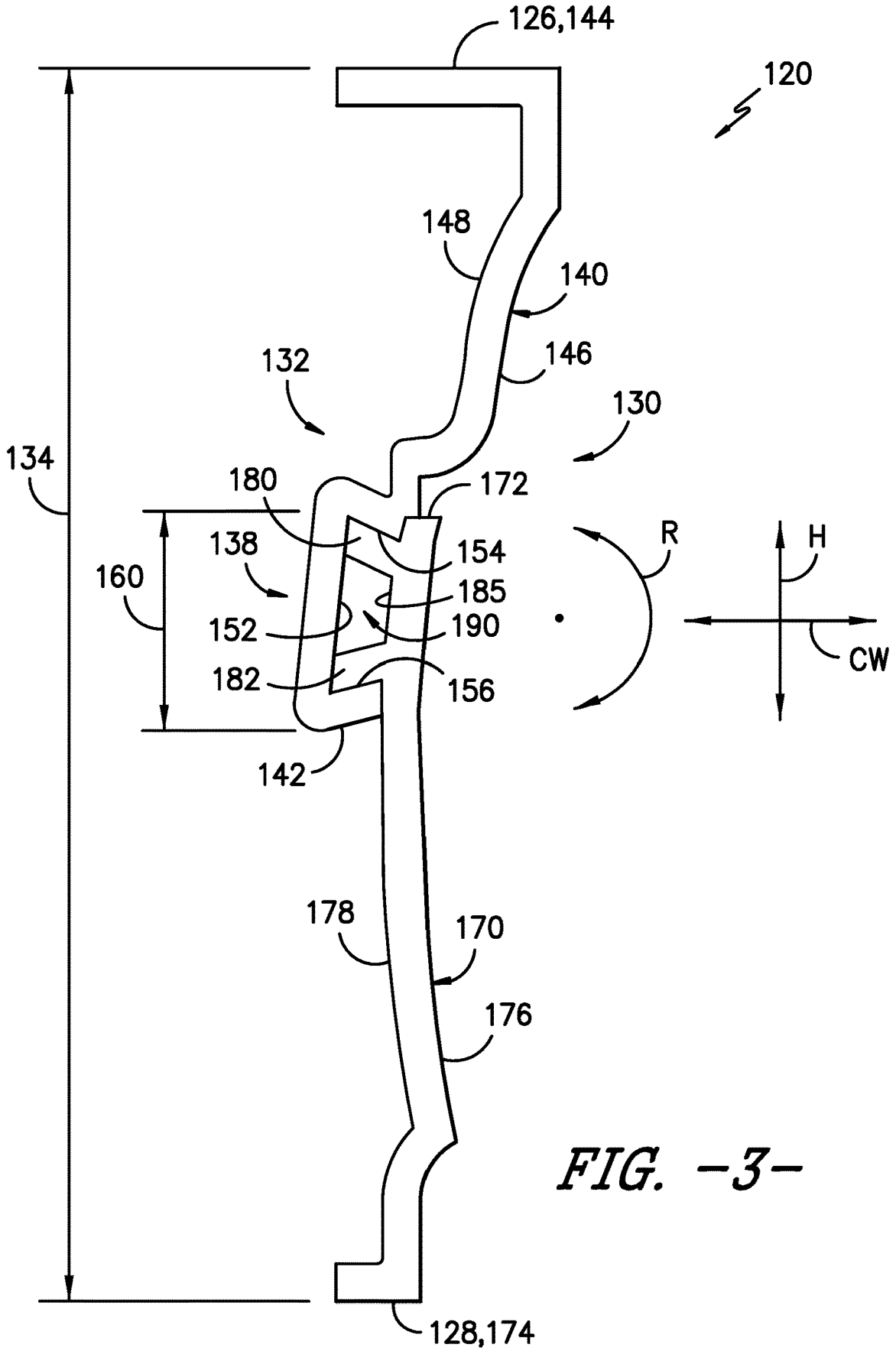
FIG. 3 illustrates an end view of the valance body shown in FIG. 2, particularly illustrating first and second body portions of the valance body assembled together.
Figure 4:
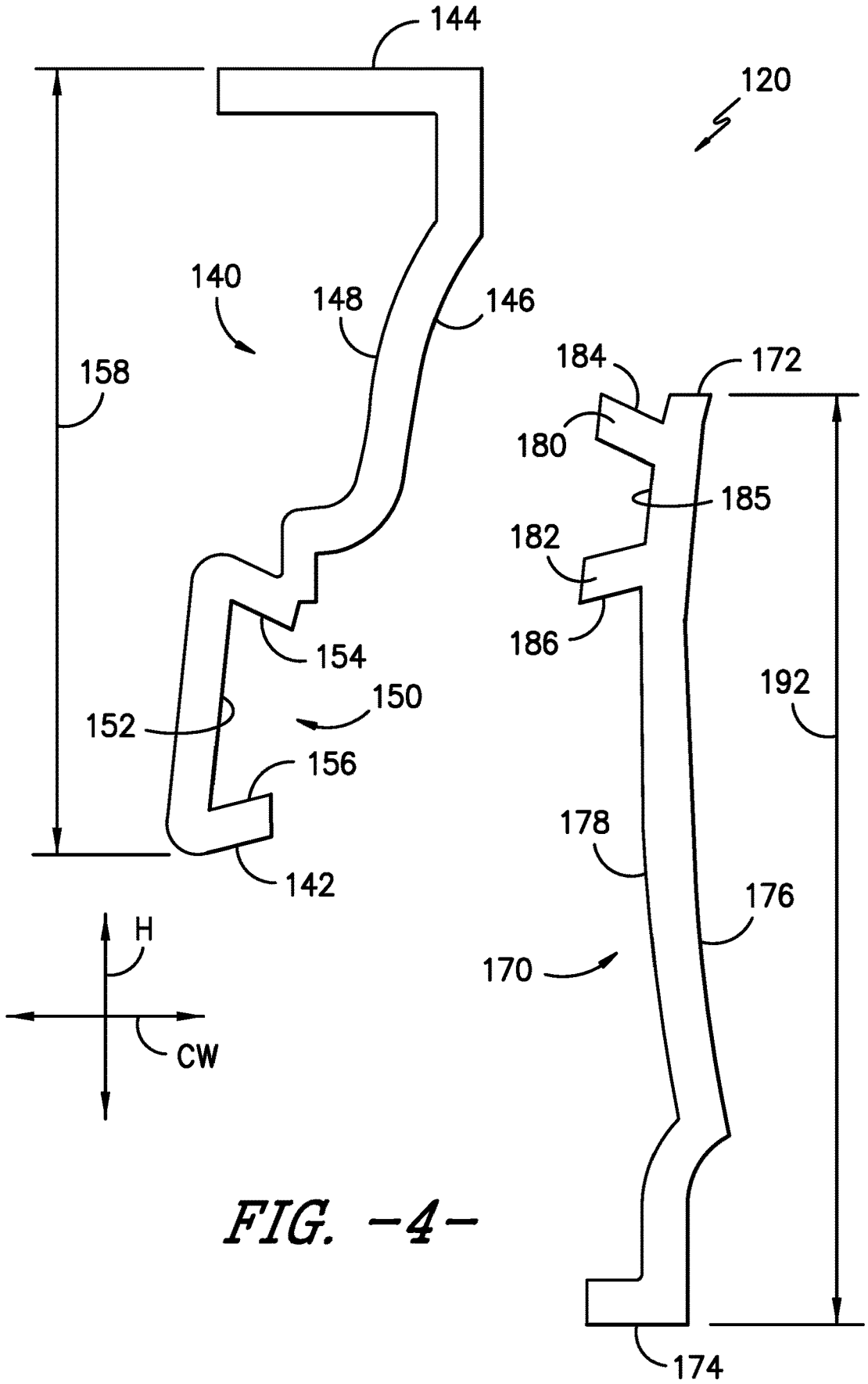
FIG. 4 illustrates another end view of the valance body shown in FIG. 2, particularly illustrating the first and second valance body portions in a disassembled or exploded state.
Figure 5:
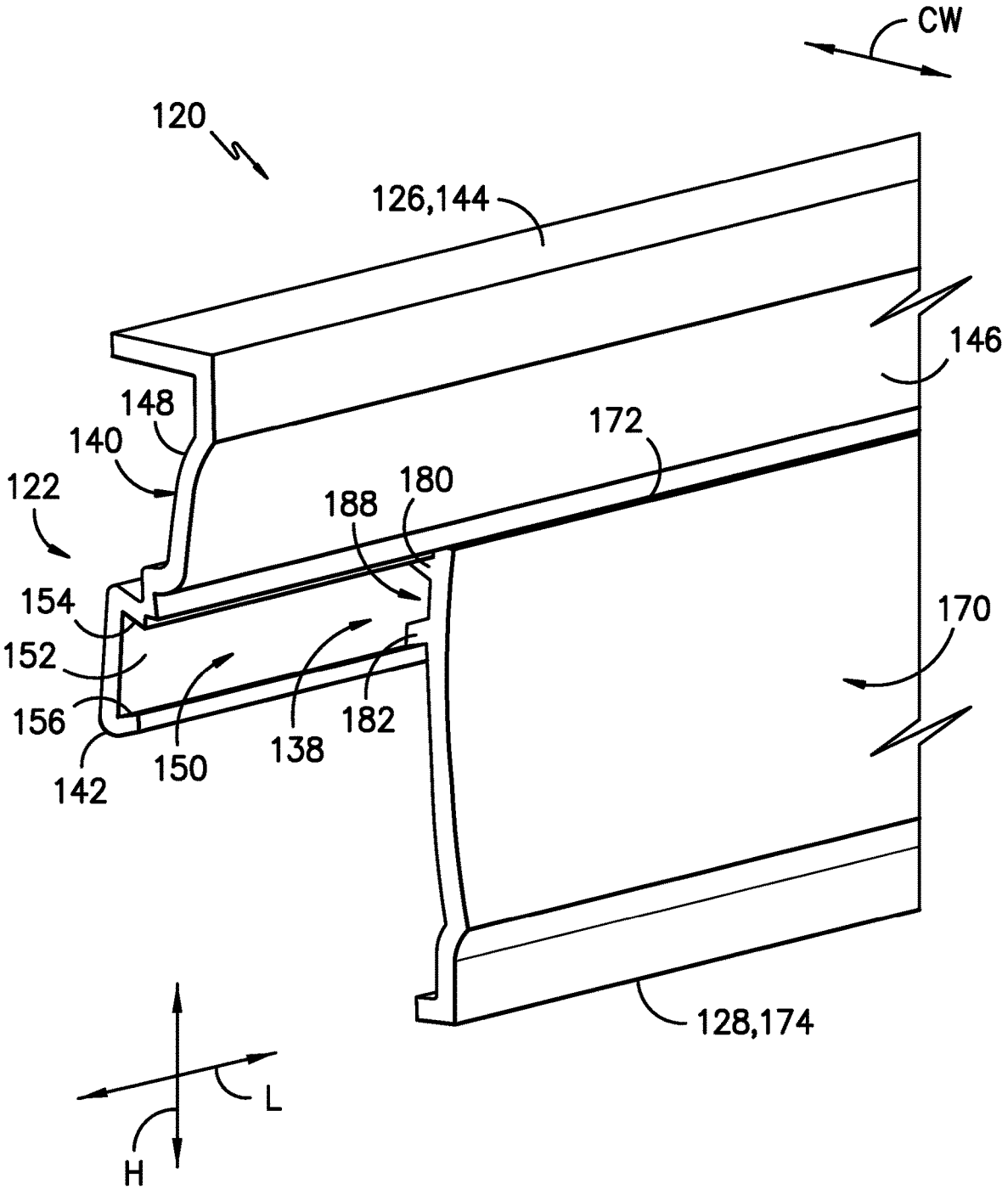
FIG. 5 illustrates a partially assembled perspective view of a portion of the valance assembly shown in FIG. 2.

Referring now to the drawings, FIGS. 1-5 illustrate differing views of one embodiment of a valance assembly 100 configured for use with a covering 102 for an architectural structure (not shown) in accordance with aspects of the present subject matter. Specifically, FIG. 1 illustrates a perspective view of the valance assembly 100 installed relative to the covering 102 and FIG. 2 illustrates another perspective view of the valance assembly 100 shown in FIG. 1 with opposed endcaps 110, 112 of the assembly 100 being exploded away from a corresponding valance body 120 of the assembly 100. Additionally, FIGS. 3 and 4 illustrate assembled and disassembled end views, respectively, of the valance body 120 shown in FIG. 2. Moreover, FIG. 5 illustrates a partially assembled perspective view of a portion of the valance body 120 shown in FIGS. 2-4.

In general, the valance assembly 100 may be configured to be installed relative to a headrail 104 (shown in dashed lines in FIG. 1) of any suitable covering 102, such as the headrail for a venetian blind, roman shade, cellular shade, vertical blind and/or any other type of covering configured to be installed relative to a window, door, or any other suitable architectural structure. As shown in FIG. 1, the valance assembly 100 is configured to be coupled to the headrail 104 so that the valance assembly 100 generally extends lengthwise along the front of the headrail 104, thereby allowing the valance assembly 100 to provide an aesthetically appealing façade or appearance to the headrail 104. In one embodiment, the valance assembly 100 is configured to be coupled to the headrail 104 using suitable valance clips (not shown) provided between the headrail 104 and the valance assembly 100. However, in other embodiments, the valance assembly 100 may be coupled to the headrail 104 using any other suitable attachment device(s) and/or connection means.

As particularly shown in FIGS. 1 and 2, the valance assembly 100 generally includes a valance body 120 extending longitudinally in a lengthwise direction (e.g., as indicated by arrows L in FIGS. 1, 2, and 5) between a first lateral end 122 and a second lateral end 124 such that the valance body 120 covers or substantially covers the front of the headrail 120 between its opposed lateral ends 122, 124. In addition, the valance body 120 extends in a vertical or heightwise direction (e.g., as indicated by arrows H in FIGS. 1-5) between a top end 126 and an opposed bottom end 118. Moreover, as shown in FIGS. 1 and 2, the valance assembly 100 may also include endcaps 110, 112 configured to be coupled to the valance body 120 at each of its opposed lateral ends 122, 124. For example, as shown in FIG. 1, a first valance endcap 110 may be coupled to the valance body at its first lateral end 122 while a second valance endcap 112 may be coupled to the valance body 120 at its second lateral end 124.

In accordance with aspects of the present subject matter, the valance body 120 may be configured as a multi-piece construction. For example, as shown in the illustrated embodiment, the valance body 120 corresponds to a two-piece construction including a first valance body portion 140 and a second valance body portion 170, with the first and second body portions 140, 170 configured to be coupled together to form the assembled valance body structure. However, in other embodiments, the valance body 120 may be formed from three or more body portions configured to be assembled together.

As particularly shown in FIG. 2, in one embodiment, a first body portion 140 may be configured to form an upper lengthwise section of the valance body 120 extending in the lengthwise direction L between the opposed lateral ends 122, 124 of the body 120 while a second body portion 170 may be configured to form a lower lengthwise section of the valance body 120 extending in the lengthwise direction L between the opposed lateral ends 122, 124, of the body 120. As shown in FIGS. 3 and 4, the first body portion 140 may generally extend in the heightwise direction H of the valance body 120 between a first joint end 142 and an opposed, first valance end 144, with the first valance end 144 generally defining or forming the top end 126 of the valance body 120. Similarly, the second body portion 170 may be configured to extend in the heightwise direction H between a second joint end 172 and an opposed, second valance end 174, with the second valance end 174 generally defining or forming the bottom end 128 of the valance body 120. Additionally, each body portion 140, 170 may be configured to extend in a cross-wise direction of the valance body 120 (e.g., as indicated by arrows CW in FIGS. 1-5) between a front side 146, 176 and a rear side 148, 178. In such an embodiment, when the body portions 140, 170 are assembled together to form the valance body 120, the front sides 146, 176 of the body portions 140, 170 may collectively define a front face 130 (FIG. 3) of the valance body 120 (i.e., the side of the valance body 120 that faces outwardly or away from the headrail 104, and, thus, is intended to be viewed) while the rear sides 148, 178 of the body portions 140, 170 may collectively define a rear face 132 (FIG. 3) of the valance body 120 (i.e., the side of the valance body 120 that faces towards the headrail 104, and, thus, is not intended to be viewed). Accordingly, the front sides 146, 176 of the valance body portions 140, 170 may generally be designed to provide an aesthetically pleasing look across the front face 130 of the valance body 120.

In several embodiments, the first and second body portions 140, 170 are configured to be coupled to each other via a joint 138 (FIGS. 2 and 4) defined between the body portions 140, 170 at or adjacent to their joint ends 142, 172. As shown in the illustrated embodiment, the joint 138 defined between the body portions 140, 170 may generally be configured to extend longitudinally in the lengthwise direction L of the valance body 120 between its opposed lateral ends 120, 122. As a result, the joint ends 142, 172 of the valance body portions 140, 170 may be configured to be coupled to each other along the entire length of the valance body 120. Additionally, in several embodiments, the joint 138 may be configured to substantially limit or constrain relative motion between the adjacent joint ends 142, 172 of the body portions 140, 170 in one or more directions. Specifically, in one embodiment, the joint 138 may be configured to limit relative motion between the adjacent joint ends 142, 172 of the body portions 140, 170 in at least two directions, such as by substantially constraining relative linear motion in both the heightwise direction H and the cross-wise direction CW of the valance body 120. Moreover, in one embodiment, the joint 138 may also be configured to limit relative rotational motion between the adjacent joint ends 142, 172 of the body portions 140, 170 in one or more directions, such as by substantially constraining relative rotational motion about a rotational axis extending in the lengthwise direction L of the valance body 120 (e.g., in the direction of rotation indicated by arrow R in FIG. 3).

In general, the joint 138 may have any suitable configuration that allows the body portions 140, 170 to be assembled together to form the valance body 120 while providing the desired relative motion constraint(s) between the first and second body portions 140, 170. For example, in one embodiment, the joint 138 is configured as a male/female joint (e.g., a dovetail joint or any other similar type joint), with one of the body portions 140, 170 defining a joint slot at or adjacent to its joint end 142, 172 that is configured to receive one or more corresponding outwardly extending projections or features of the other body portion 140, 170. Specifically, in the embodiment shown in FIGS. 4 and 5, the first body portion 140 is configured to define a joint slot 150 extending in the lengthwise direction L of the valance body 120, with the second body portion 170 including a corresponding or mating feature(s) 180, 182 configured to be received within the joint slot 150. However, in other embodiments, the configuration may be reversed, with the second body portion 170 defining the joint slot and the first body portion 140 including the corresponding or mating feature(s).

As shown in FIG. 4, the joint slot 150 extends in the lengthwise direction L of the valance body 120 along the front side 146 of the first body portion 140 and is defined by a base slot wall section 152 of the first body portion 140 extending in the heightwise direction H between opposed, first and second angled wall sections 154, 156 of the first body portion 140. As particularly shown in FIG. 4, each angled wall section 154, 156 is oriented towards the opposed angled wall section 154, 156 so as to define an acute angle relative to the base slot wall section 152 defining the closed end of the joint slot 150, thereby providing the slot 150 with a converging profile (e.g., a dovetail shape) as each angled wall section 154, 156 extends outwardly from the base slot wall section 152. For instance, the angled wall sections 154, 156 may be oriented relative to the base slot wall section 152 and relative to each other such that a heightwise distance defined between the angled wall sections 154, 156 decreases as the wall sections 154 156 extend outwardly from the base slot wall section 152. As such, the height of the open end of the joint slot 150 is smaller than the remainder of the height of the slot 150, thereby allowing the corresponding feature(s) of the second body portion 170 to be retained within the slot 150.

Additionally, as indicated above, the second body portion 170 may include one or more corresponding features configured to be received within the joint slot 150 to allow the body portions 140, 170 to be coupled to each other at the joint 138. Specifically, in the embodiment shown in FIG. 4, the second body portion 170 includes first and second angled projections 180, 182 extending outwardly in the cross-wise direction CW of the valance body 120 along the rear side 178 of the second body portion 170 at locations adjacent to its joint end 172, with the angled projections 180, 182 defining diverging angled profiles that are complementary to the converging angled profiles of the angled wall sections 154, 156 of the joint slot 150. As such, when the angled projections 180, 182 are received within the joint slot 150, the first angled projection 180 may contact or otherwise be disposed immediately adjacent to the first angled wall section 154 along an outer surface 184 (FIG. 4) of the first angled projection 180 while the second angled projection 182 may contact or otherwise be disposed immediately adjacent to the second angled wall section 156 along an outer surface 186 (FIG. 4) of the second angled projection 182. Accordingly, due to the configuration of the illustrated joint 138, the engagement between the angled wall sections 154, 156 defining the sides of the joint slot 150 and the corresponding angled projections 180, 182 may limit relative linear motion between the first and second body portions 140, 170 in both the heightwise direction H and the cross-wise direction CW, as well as limit rotational motion about a rotational axis extending in the lengthwise direction L of the valance body 120 (e.g., in the direction of rotation indicated by arrow R in FIG. 3).

It should be appreciated that the illustrated joint configuration may allow the first and second body portions 140, 170 to be moved relative to each other in the lengthwise direction L of the valance body 120. As such, the first and second body portions 140, 170 may be assembled together by sliding or moving the components relative to each other along the lengthwise direction L of the valance body 120. For instance, a lateral end 188 (FIG. 5) of each angled projection 180, 182 may be inserted into the joint slot 150 along the lengthwise direction L at one of the lateral ends of the joint slot 150. The second body portion 170 may then be slid or moved relative to the first body portion 140 (or vice versa) until the lateral ends 188 of the angled projections 180, 182 are properly aligned with the opposed lateral end of the joint slot 150.

It should also be appreciated that, by configuring the second body portion 170 to include separate angled projections 180, 182 spaced apart from each other in the heightwise direction H of the valance body 120, an open volume or cavity 190 may be defined within the joint slot 150 between the first and second body portions 140, 170 when the body portions 140, 170 are assembled together. For instance, as shown in FIG. 3, the cavity 190 may extend in the heightwise direction H directly between the first and second angled projections 180, 182 and in the cross-wise direction CW between the base slot wall section 152 of the first body portion 140 and the opposed surface/wall 185 of the second body portion 170. In such an embodiment, the cavity 190 may provide an opening or insertion slot for coupling the endcaps 110, 112 to the valance body 120. Specifically, as shown in FIG. 2, each endcap 110, 112 may include an engagement or retention feature, such as an outwardly extending post 114, configured to be received within the open cavity 190. For instance, each post 114 may be configured to define a shape or profile generally corresponding to the shape or profile of the cavity 190. As such, when the endcaps 110, 112 are installed relative to the lateral ends 122, 124 of the valance body 120, the posts 114 may be received within the open cavity 190 at each lateral end 122, 124 of the valance body 120 to facilitate coupling the endcaps 110, 112 to the body 120. However, in other embodiments, the endcaps 110, 112 may be coupled to the valance body 120 using any other suitable attachment structure and/or means, such as by using clips or any other suitable mechanical fasteners.

In alternative embodiments, as opposed to the separate angled projections 180, 182, the second body portion 170 may include a single, continuous mating feature or projection configured to be received within the joint slot 150. For instance, the second body portion 170 may include a single projection extending outwardly relative to its rear side 178 that defines a shape that is complementary to the joint slot 150, such as by defining a dovetail shape or any other similar shape that diverges outwardly from the second body portion 170 so as to match the converging profile of the joint slot 150.

As particularly shown in FIGS. 2 and 3, when assembled, the valance body 120 may define an overall height 134 between its top and bottom ends 126, 128 that is greater than the individual heights of the body portions 140, 170. For instance, as shown in FIG. 4, the first body portion 140 may define a first height 158 between its opposed ends 142, 144 while the second body portion 170 may define a second height 192 between its opposed ends 172, 174. In such an embodiment, the overall height 134 of the assembled valance body 120 may generally correspond to the summation of the first and second heights 158, 192 less a heightwise distance 160 (FIG. 3) across which the body portions 140, 170 overlap at the joint 138. Thus, the individual heights 158, 192 of the body portions 140, 170, along with the overlapped distance 160 defined at the joint 138, may be selected so as to provide the assembled valance body 120 with a desired height.

Despite the increased overall height of the valance body 120, the disclosed multi-piece construction allows the separate body portions 140, 170 to be nested or otherwise provided in an overlapping heightwise configuration when in a disassembled state, thereby permitting the body portions 140, 170 to be arranged relative to each other so as to extend across a significantly smaller heightwise distance as compared to the overall height 134 of the assembled valance body 102. As a result, the packaging for the disclosed valance assembly 100 need only be designed to accommodate the heightwise profile of the body portions 140, 170 when in their nested or overlapped state (as opposed to accommodating the overall height 134 of the valance body 120).

Figure 6:
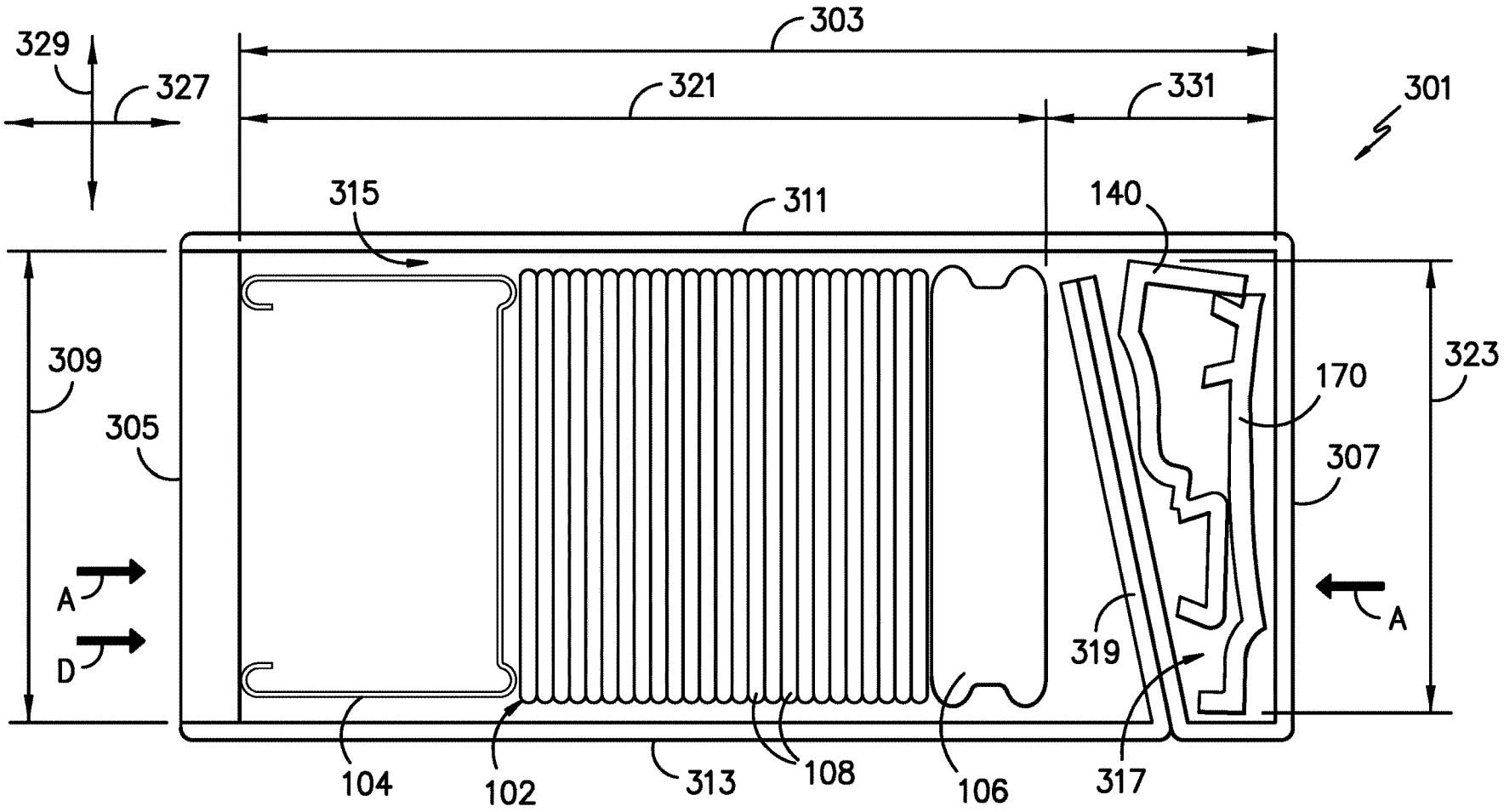
FIG. 6 illustrates an end view of one embodiment of a packaged window covering and valance assembly in accordance with aspects of the present subject matter, particularly illustrating components of the covering and the valance assembly shown in FIG. 1 positioned within the package.

For instance, FIG. 6 illustrates a cross-sectional view of components of the window covering 102 and the valance assembly 100 shown in FIG. 1 arranged within one embodiment of a suitable package 301 for retaining the covering/assembly 102/100. As shown, the package 301 defines a storage area for the covering/assembly 102, 100 having an overall width 303 extending in a first packaging direction (e.g., as indicated by arrow 327) between opposed first and second endwalls 305, 307 of the package 301 and an overall height 309 extending in a second packaging direction (e.g., as indicated by arrow 329) between opposed first and second sidewalls 311, 313 of the package 301. Additionally, in several embodiments, the storage area may be divided, at least partially, between its opposed endwalls 305, 307 into separate storage compartments for isolating the window covering 102 relative to one or more components of the valance assembly 100. For instance, as shown in FIG. 6, the package 301 may include a primary or first storage compartment 315 for receiving the window covering 100, and a secondary or second storage compartment 317 for receiving the first and second body portions 140, 170 of the valance assembly 100, with the first and second storage compartments 315, 317 being separated by an internal dividing wall(s) 319 extending at least partially between the opposed sidewalls 311, 313 of the package 301. In such an embodiment, the first storage compartment 315 may be sized and configured to accommodate the various components of the window covering 102, such as the headrail 104, an opposed bottom rail 106, and a shade material or covering assembly (e.g., a plurality of slats 108) positioned between the headrail 104 and the bottom rail 106. For example, as shown in FIG. 6, a width 321 of the first storage compartment 315 may be selected to accommodate the stacked vertical profile of the various window covering components. Moreover, the height of the first storage compartment 315 may generally correspond to the overall height 309 of the storage area, which may be selected to accommodate the corresponding maximum cross-wise dimension of the window covering 102.

It should be appreciated that, by selecting the overall height 309 of the storage area to accommodate the maximum cross-wise dimension of the window covering 102, the overall height 309 may, in many instances, be less than the overall height 134 of the assembled valance body 120, particularly when it is desired for the valance body 120 to have a significantly increased overall height 134. Accordingly, to allow the valance body 120 to be packaged within the second storage compartment 317 such that the valance body portions 140, 170 are oriented in the heightwise direction H between the opposed sidewalls 311, 313 of the package 301, the valance body 120 may be provided in its disassembled state for packaging. In such an embodiment, the second storage compartment 317 need only be sized and configured to accommodate the valance body portions 140, 170 when they are disassembled and located side-by-side, such as when the valance body portions 140, 170 are in their nesting or overlapping heightwise configuration. For instance, as shown in FIG. 6, the first and second body portions 140, 170 may be positioned relative to each other such that the body portions 140, 170 substantially overlap each other within the second storage compartment 317, such as by positioning the body portions in a side-by-side nesting configuration within the second storage compartment 317 along the heightwise direction H of the body portions 140, 170. As a result, the heightwise profile of the valance body portions 140, 170, as packaged, may be significantly reduced as compared to the heightwise profile of the assembled valance body 102. Specifically, when in the nested or overlapped state, the body portions 140, 170 may collectively extend across a heightwise distance 323 that is significantly smaller than the overall height of the valance body 120, thereby allowing the body portions 140, 170 to fit within the height constraints of the package 301. As a result, the disclosed valance body portions 140, 170 may be packaged within the second storage compartment 317 without requiring the dimensions of the package 301 to be modified to accommodate the larger overall height 134 of the valance body 120 and without adjusting the orientation of the valance body portions 140, 170 within the package 301, which, as will be described below, may be desirable for allowing the valance body portions 140, 170 to be cut in package along with the window covering using a cut-down or size-in-store (SIS) machine.

Figure 7:
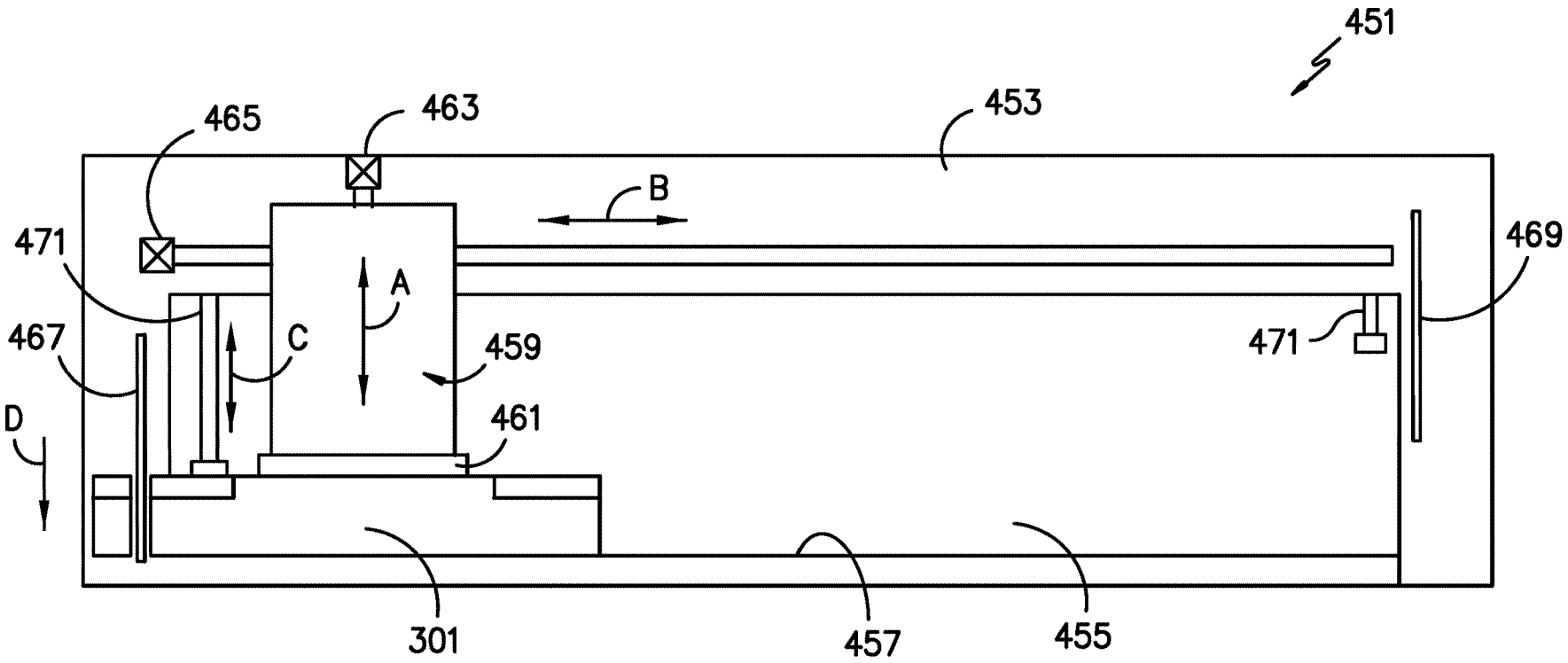
FIG. 7 illustrates a schematic view of one embodiment of a cut-down or size-in-store machine suitable for sizing the disclosed valance assembly and associated covering in accordance with aspects of the present subject matter.

Referring now to FIG. 7, a schematic view of one embodiment of a SIS machine 451 that can be used to cut the covering/assembly 102, 100 within the package 301 described above with reference to FIG. 6 is illustrated in accordance with aspects of the present subject matter. As shown, the SIS machine 451 may include a body or frame 453 that supports a horizontal platform 455, with the platform 455 defining a horizontal, substantially flat surface on top which the package 301 is configured to be placed. Additionally, a lateral surface 457 may be located along the front edge of the platform 455 that defines a low friction surface (e.g., via a plurality of rollers provided along the lateral surface 457) to facilitate movement of the package 301 across the platform 455. During measuring and cutting operations, the package 301 may be pressed against the lateral surface 457 and slid across the platform 455 using a movement assembly 459 of the SIS machine 451. As shown in FIG. 7, the movement assembly 459 may include a jaw 461 that is configured for reciprocating linear movement along a holding direction (indicated by arrow A) by a linear drive 463 (e.g., a linear actuator, such as a hydraulic or pneumatic cylinder) so that the jaw 461 may be selectively reciprocated toward and away from lateral surface 457 to compress and release the package 301 relative to the surface 457, respectively. Moreover, a second linear drive 465 (e.g., a rack and pinion or ball screw drive) may also be coupled to the movement assembly 459 to reciprocate the assembly 459 in a lateral direction (indicated by arrow B) along the length of the platform 455 to position the movement assembly 459 relative to cutting mechanisms 467, 469 (e.g., saws) located at each end of platform 455.

To trim the lateral ends of the window covering 102 and valance body portions 140, 170 contained within the package 301, the jaw 461 may be initially extended in the holding direction A to compress the package 301 against lateral surface 457. The movement assembly 459 may then be moved relative to platform 455 in the lateral direction B to position the package 301 relative to one of the cutting mechanisms (e.g., the left cutting mechanism 467). Once the package 301 has been properly positioned relative to the desired cutting mechanism 467, a stationary holding device 471 may be extended (e.g., as represented by arrow C) to press the end of the package 301 against the lateral surface 457 during the cutting operation. The adjacent cutting mechanism 467 may then be reciprocated transversely to the platform 455 to cut the through the package 301, thereby cutting off the adjacent ends of the window covering 102 and valance body portions 140, 170 contained within the package 301. Thereafter, the movement assembly 459 may be used to move the package 301 to the other end of the platform 455 to allow the opposed ends of the window covering 102 and valance body portions 140, 170 to be trimmed via the cutting mechanism 469 positioned at such opposed end of the platform 455.

It should be appreciated that, when trimming the ends of a window covering and associated valance assembly using the SIS machine 451 shown in FIG. 7, the disclosed package 301 is configured to be placed on the horizontal platform 455 in the orientation shown in FIG. 6 such that one of the sidewalls 311, 313 of the package 301 rests directly on top of the platform 455 and the endwalls 305, 307 of the package 301 extend upward generally perpendicularly from the platform 455. Thus, when the package 301 is compressed between the jaw 461 and the lateral surface 457 of the machine 451, a compressive force is applied through the package 301 in the direction transverse to the orientation of the endwalls 305, 307 of the package 301 (e.g., as indicated by arrows A in FIG. 6). Accordingly, to ensure that the ends of the valance body portions 140, 170 are properly trimmed during the cutting operation, it is desirable for the body portions 140, 170 to be oriented heightwise within the package 301 in the manner shown in FIG. 6 (e.g., by being oriented in their heightwise direction generally parallel to the second packaging direction 329 of the package 301 and generally perpendicular to the first packaging direction 327 of the package 301) to allow the compressive force A applied by the movement assembly 459 to compress the valance body portions 140, 170 in a direction generally perpendicular to the heightwise direction H of the body portions 140, 170, thereby ensuring that the valance body portions 140, 170 are maintained stationary within the package 301 during the cutting operation. Moreover, such orientation of the body portions 140, 170 within the package 301 may allow the cutting mechanisms 467, 469 to cut across the smallest dimension of each body portion 140, 170 (i.e., across the cross-wise direction CW of each body portion 140, 170), thereby providing a cleaner, more efficient cut. For instance, similar to the holding direction A, the cutting direction for the cutting mechanisms 467, 469 (e.g., as indicated by arrow D in FIG. 6) may generally be oriented perpendicular to the heightwise direction H of the body portions 140, 170.

Figure 8:
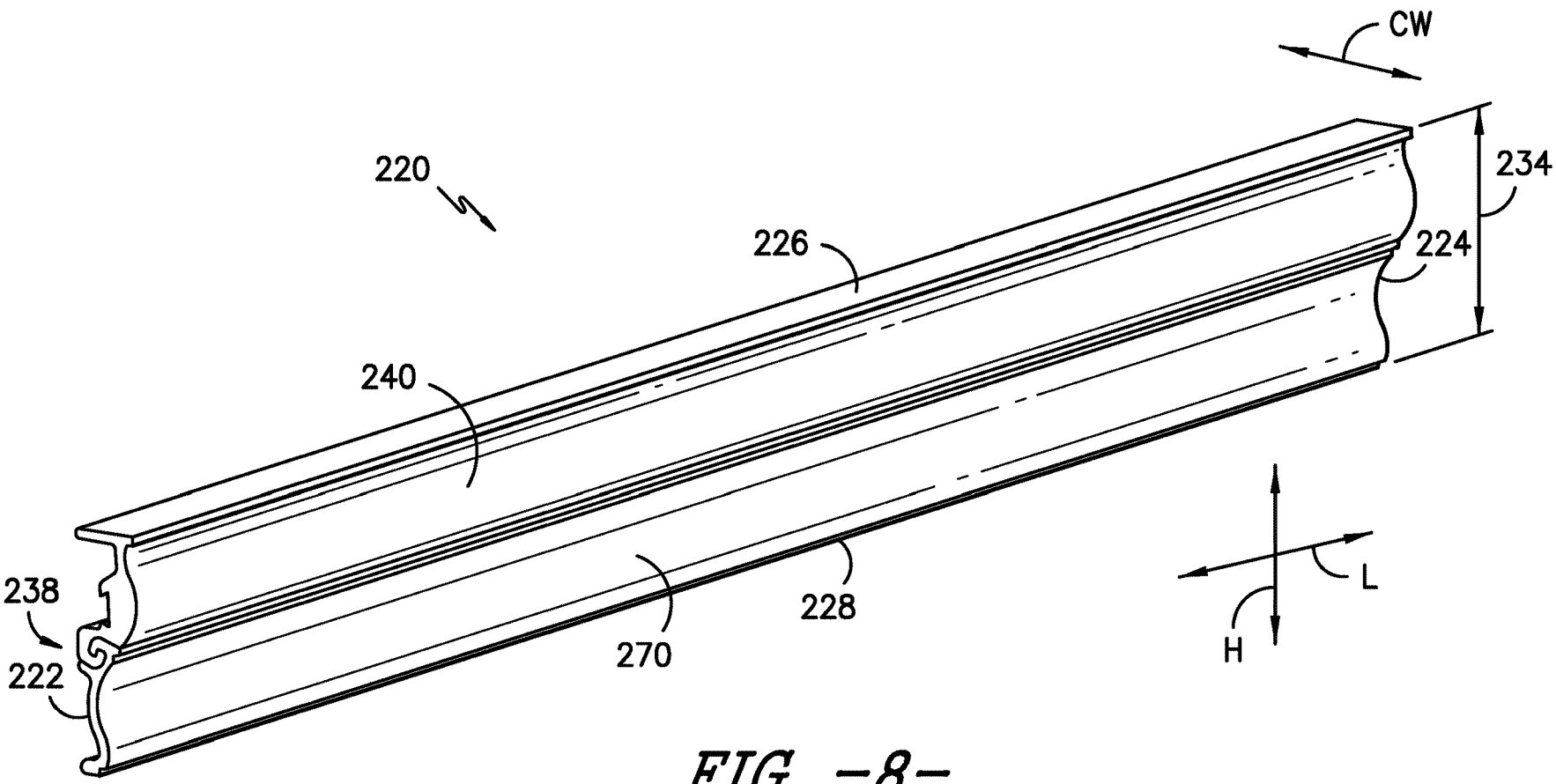
FIG. 8 illustrates a perspective view of another embodiment of a multi-piece valance body in accordance with aspects of the present subject matter.
Figure 9:
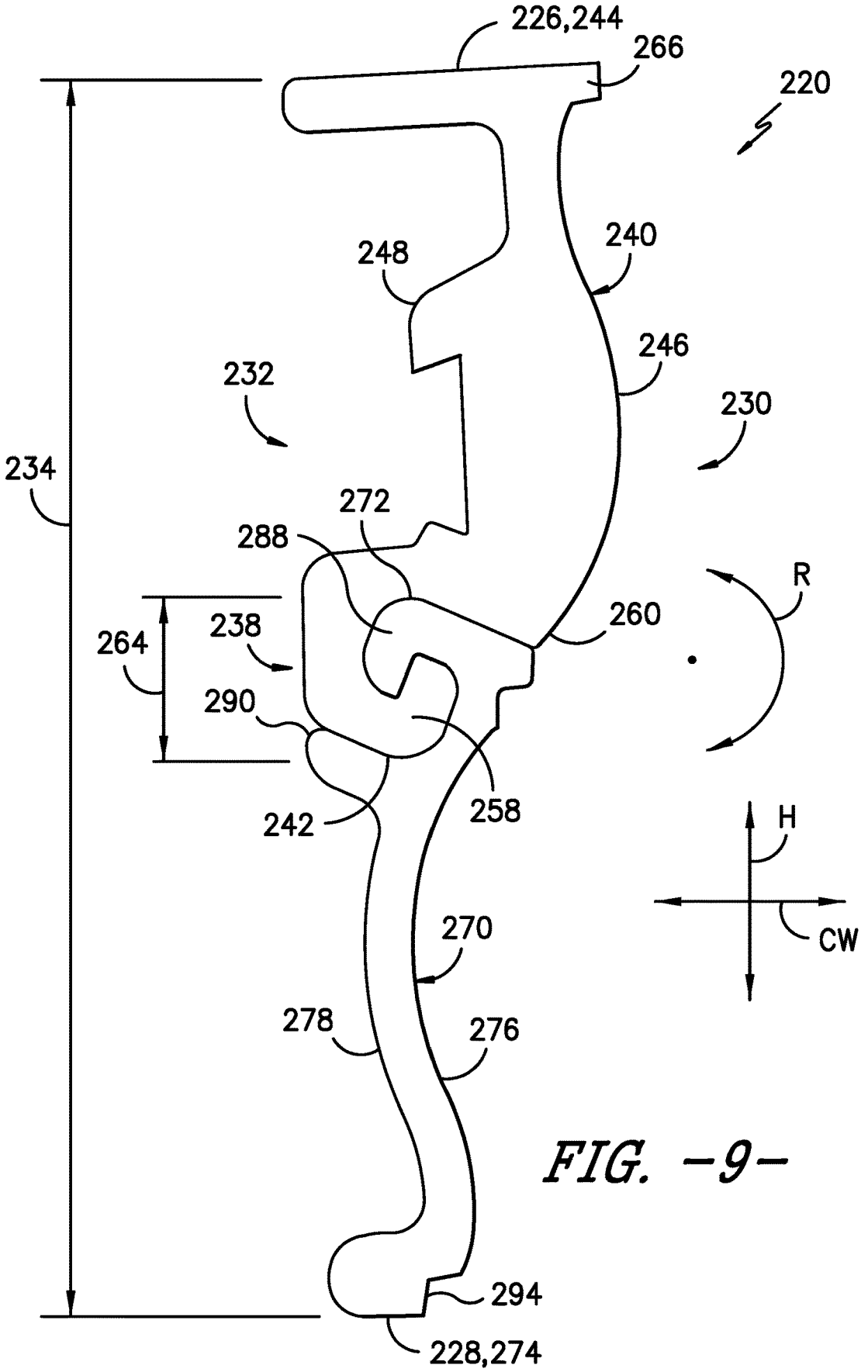
FIG. 9 illustrates an end view of the valance body shown in FIG. 8, particularly illustrating first and second body portions of the valance body assembled together.
Figure 10:
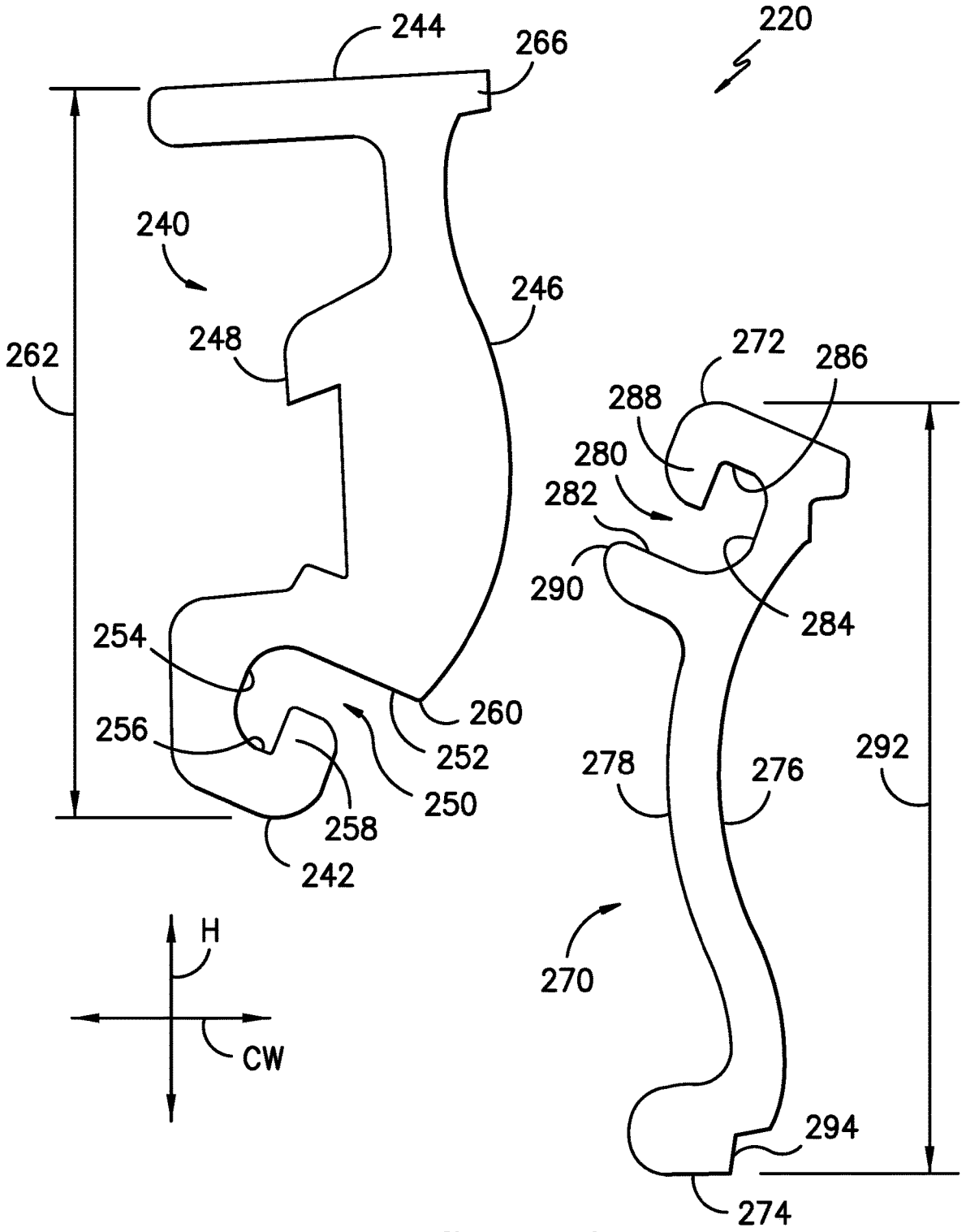
FIG. 10 illustrates another end view of the valance body shown in FIG. 8, particularly illustrating the first and second valance body portions in a disassembled or exploded state.
Figure 11:
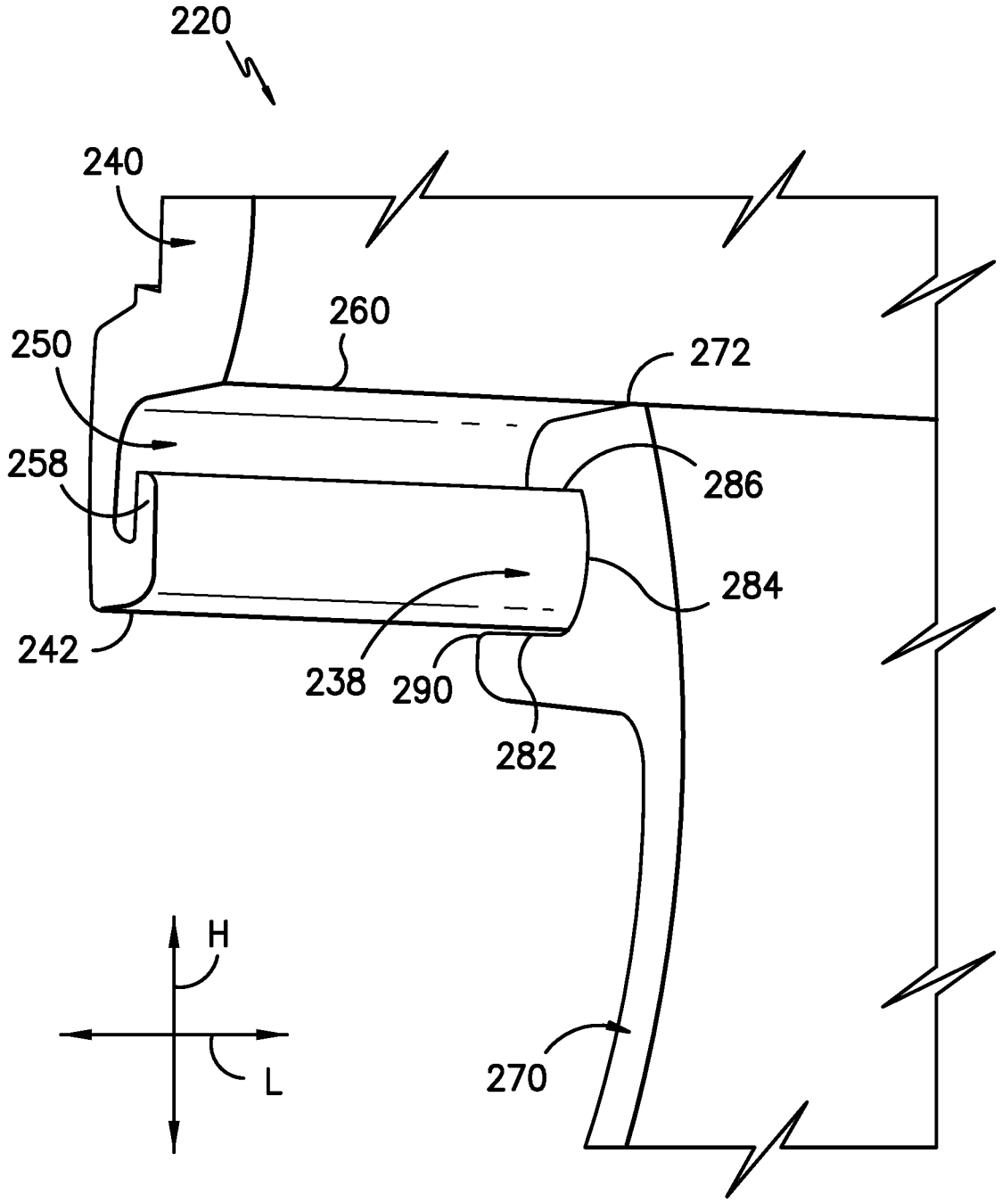
FIG. 11 illustrates a partially assembled perspective view of a portion of the valance assembly shown in FIG. 8.

Referring now to FIGS. 8-11, several views of another embodiment of a valance body 220 suitable for use within the disclosed valance assembly 100 are illustrated in accordance with aspects of the present subject matter. Specifically, FIG. 8 illustrates a perspective view of the valance body 220 and FIG. 9 illustrates an end view of the assembled valance body 220 shown in FIG. 8. Additionally, FIG. 10 illustrates a disassembled or exploded end view of the valance body 200 shown in FIG. 9, while FIG. 11 illustrates a partially assembled view of a portion of the valance body 220 shown in FIGS. 8-10.

As particularly shown in FIG. 8, the valance body 220 may generally be configured similar to the valance body 120 described above. For instance, the valance body 220 may extend longitudinally in a lengthwise direction (e.g., as indicated by arrow L in FIGS. 8 and 11) between a first lateral end 222 and a second lateral end 224 such that the valance body 220 is configured to cover or substantially cover the front of an adjacent headrail 104 (FIG. 1) between the opposed lateral ends 222, 224. In addition, the valance body 220 may extend in a vertical or heightwise direction (e.g., as indicated by arrows H in FIGS. 8-11) between a top end 226 and an opposed bottom end 228.

Moreover, similar to the embodiment described above, the valance body 220 may be configured as a two-piece construction including a first body portion 240 and a second body portion 270, with the first and second body portions 240, 270 configured to be coupled together to form the complete valance body structure. As particularly shown in FIG. 8, in one embodiment, the first body portion 240 may be configured to form an upper lengthwise section of the valance body extending in the lengthwise direction L between the first and second lateral ends 222, 224 of the valance body 220, while the second body portion 270 may be configured to form a lower lengthwise section of the valance body 220 extending in the lengthwise direction L between the first and second lateral ends 222, 224 of the valance body 220. Additionally, as shown in FIG. 10, the first body portion 240 may generally extend in the heightwise direction H of the valance body 220 between a first joint end 242 and an opposed first valance end 244, with the first valance end 244 generally defining or forming the top end 276 of the valance body 220. Similarly, the second body portion 270 may be configured to extend in the heightwise direction H between a second joint end 272 and an opposed second valance end 274, with the second valance end 274 generally defining or forming the bottom end 228 of the valance body 220.

Each body portion 240, 270 may also be configured to extend in a cross-wise direction of the valance body 220 (e.g., as indicated by arrow CW in FIGS. 8-10) between a front side 246, 276 and a rear side 248, 278. In such an embodiment, when the body portions 240, 270 are assembled together to form the valance body 220, the front sides 246, 276 of the body portions 240, 270 may collectively define a front face 230 of the valance body 220 (i.e., the side of the valance body 220 that faces outwardly or away from the headrail 104 (FIG. 1), and, thus, is intended to be viewed) while the rear sides 248, 278 of the body portions 240, 270 may collectively define a rear face 232 of the valance body 220 (i.e., the side of the valance body 220 that faces towards the headrail 104, and, thus, is not intended to be viewed). Accordingly, the front sides 246, 276 of the valance body portions 240, 270 may generally be designed to provide an aesthetically pleasing look across the front face 230 of the valance body 220.

In several embodiments, the first and second body portions 240, 270 may be configured to be coupled to each other via a joint 238 defined between the body portions 240, 270 at or adjacent to their joint ends 242, 272. As shown in the illustrated embodiment, the joint 238 defined between the body portions 240, 270 may generally be configured to extend longitudinally in the lengthwise direction L of the valance body 220 between its opposed lateral ends 222, 224. As a result, the joint ends 242, 272 of the valance body portions 240, 270 may be configured to be coupled to each other along the entire length of the valance body 220. Similar to the embodiment described above, the joint 238 may, in several embodiments, be configured to substantially limit or constrain relative motion between the adjacent joint ends 242, 272 of the body portions 240, 270 in one or more directions. For instance, in one embodiment, the joint 238 may be configured to limit relative motion between the adjacent joint ends 242, 272 of the body portions 240, 270 in at least two directions, such as by substantially constraining relative linear motion in both the heightwise direction H and the cross-wise direction CW of the valance body 220. Moreover, in one embodiment, the joint 238 may be configured to limit relative rotational motion between the adjacent joint ends 242, 272 of the body portions 240, 270 in one or more directions, such as by substantially constraining relative rotational motion about a rotational axis extending in the lengthwise direction L of the valance body 120 (e.g., in the direction of rotation indicated by arrow R in FIG. 9).

As shown in the illustrated embodiment, the joint ends 242, 244 of the first and second body portions 240, 270 define mating or complementary profiles so as to form a male/female joint between the body portions 240, 270, with each body portion 240, 270 defining a joint slot 250, 280 (FIG. 10) for receiving a corresponding feature or projection of the other body portion 240, 270. Specifically, as shown in FIG. 10, the first body portion 240 generally forms a "C-shaped" heightwise profile adjacent to its joint end 242 that defines a first joint slot 250, with the first joint slot 250 being open along the front side 246 of the body portion 240. For example, the "C-shaped" heightwise profile of the first joint slot 250 may be defined by a first upper wall section 252, a first recessed wall section 254, a first lower wall section 256, and a first joint lip 258 of the first body portion 240, with the first upper wall section 252 extending from a front edge 260 of the first body portion 240 to the first recessed wall section 254 and the first lower wall section 256 extending between the first recessed wall section 254 and the first joint lip 258. In such an embodiment, the first joint groove 250 may generally extend in the cross-wise direction CW of the valance body 220 towards the rear side 248 of the first body portion 240 between the first joint lip 258 and the first upper wall section 252 and wrap around the first joint lip 258 along the first recessed wall section 254 of the first body portion 240 so as to define a partially arcuate shaped slot profile. Similarly, as shown in FIG. 10, the second body portion 270 generally forms a complementary reverse "C-shaped" heightwise profile adjacent to its joint end 272 that defines a second joint slot 280, with the second joint slot 280 being open along the rear side 278 of the second body portion 270. For example, the reverse "C-shaped" heightwise profile of the second joint slot 280 may be defined by a second lower wall section 282, a second recessed wall section 284, a second upper wall section 286, and a second joint lip 288 of the second body portion 270, with the second lower wall section 282 extending from a rear edge 290 of the second body portion 270 to the second recessed wall section 284 and the second upper wall section 286 extending between the second recessed wall section 284 and the second joint lip 288. In such an embodiment, the second joint slot 280 may generally extend in the cross-wise direction CW of the valance body 220 towards the front side 276 of the second body portion 270 between the second joint lip 288 and second lower wall section 282 and wrap around the second joint lip 288 along the second recessed wall section 284 of the second body portion 270 so as to define a partially arcuate shaped slot profile.

With the illustrated joint configuration, the first and second body portions 240, 270 may be assembled together by aligning the joint ends 242, 272 of the body portions 240, 270 and subsequently sliding or moving the components relative to each other along the lengthwise direction L of the valance body 220. Specifically, the joint end 242 of the first body portion 240 may be aligned with the second joint groove 280 of the second body portion 270 such that the first joint lip 258 is received within the second joint slot 280 between the second joint lip 288 and the second recessed wall section 284 of the second body portion 270. Similarly, the joint end 272 of the second body portion 270 may be aligned with the first joint slot 250 of the first body portion 240 such that the second joint lip 288 is received within the first joint slot 250 between the first joint lip 258 and the first recessed wall section 254 of the first body portion 240. As a result, the joint lips 258, 288 of the first and second body portions 240, 270 may engage each other and interlock the joint ends 242, 272 of the body portions 240, 270 together, thereby forming assembled valance body structure. In addition, such interlocking of the joint ends 242, 272 of the body portions 240, 270 together may function to limit relative linear motion of the body portions 240, 270 in both the heightwise direction H and the cross-wise CW direction of the valance body 220. Moreover, the engagement between the joint ends 242, 272 of the body portions 240, 270 may also limit relative rotational motion of the body portions 240, 270 along an axis extending parallel to the lengthwise direction L of the valance body 220.

As particularly shown in FIGS. 9 and 10, when assembled, the valance body 220 may define an overall height 234 between its top and bottom ends 226, 228 that is greater than the individual heights of the body portions 240, 270. For instance, as shown in FIG. 10, the first body portion 240 may define a first height 262 between its opposed ends 242. 244 while the second body portion 270 may define a second height 292 between its opposed ends 272, 274. In such an embodiment, the overall height 234 of the assembled valance body 220 may generally correspond to the summation of the first and second heights 262, 292 less the heightwise distance 264 (FIG. 9) across which the body portions 240, 270 overlap at the joint 238. Thus, the individual heights 262, 292 of the body portions 240, 270, along with the overlapped distance 264 defined at the joint 238, may be selected so as to provide the assembled valance body 220 with a desired height.

Figure 12:
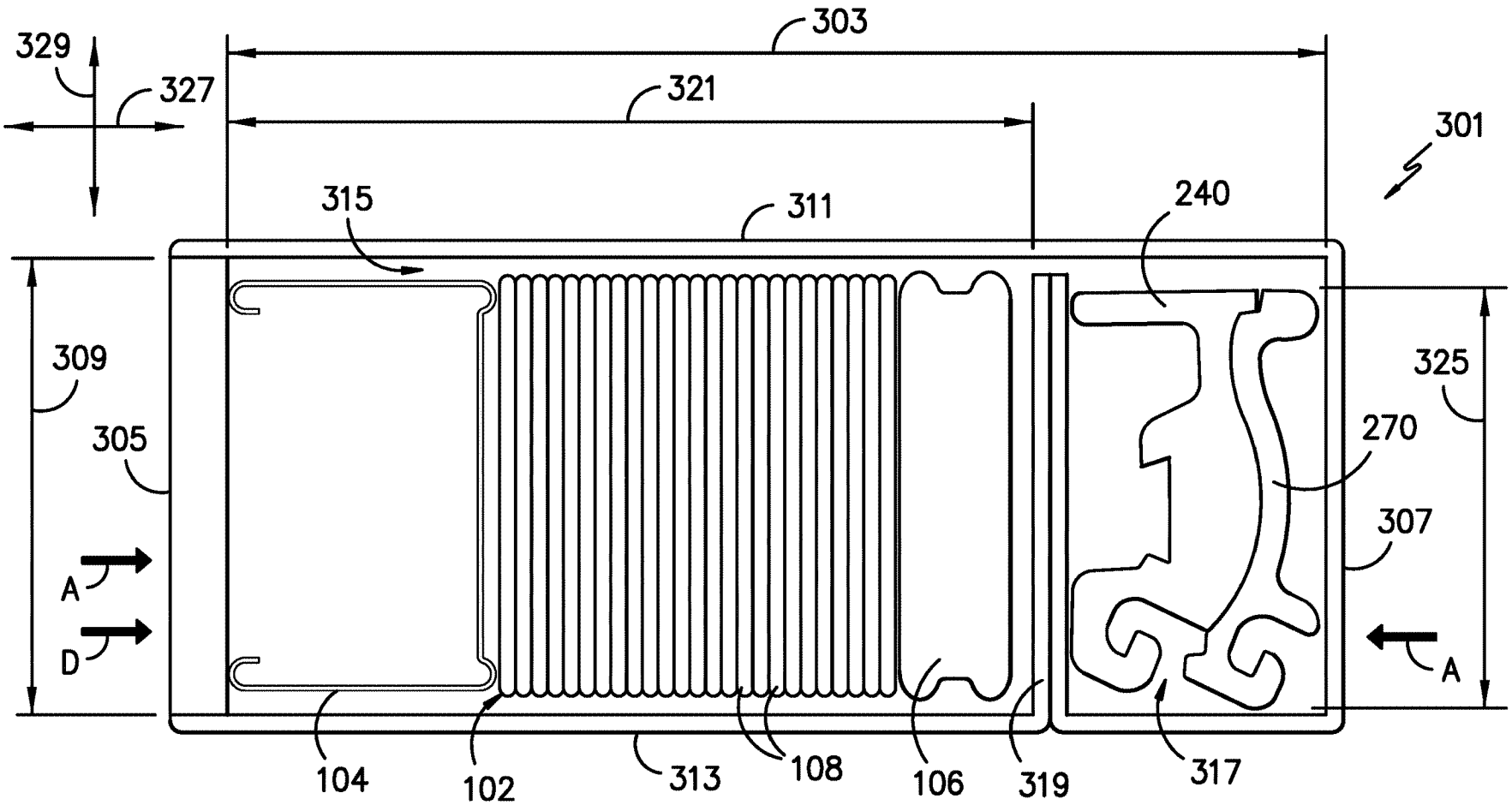
FIG. 12 illustrates an end view of another embodiment of the packaged assembly shown in FIG. 6, particularly illustrating the first and second body portions of the valance body shown in FIG. 8 positioned within the package along with the components of the covering shown in FIG. 1.
Figure 13:
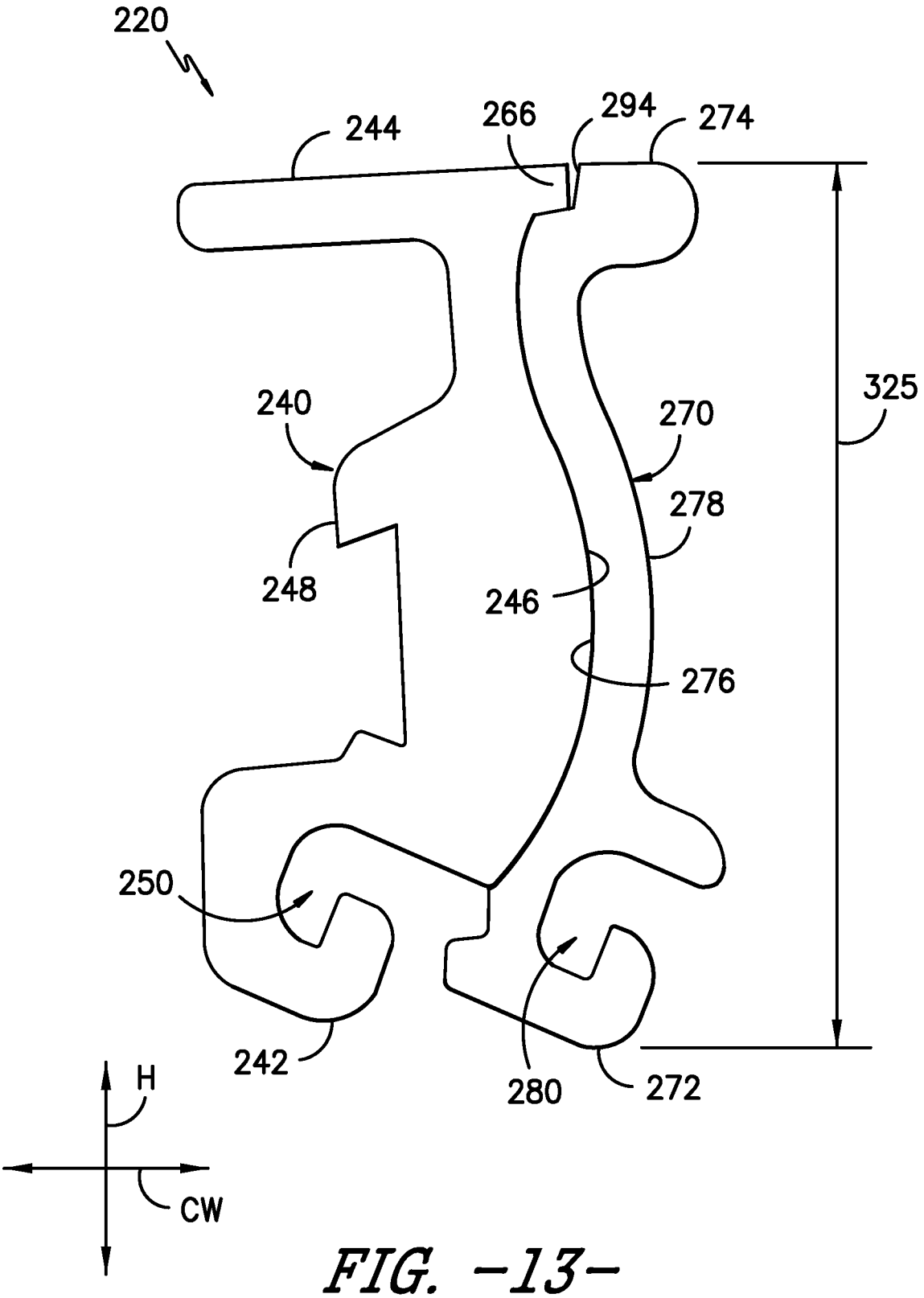
FIG. 13 illustrates an end view of the packaged configuration of the valance body portions shown in FIG. 12, particularly illustrating the first and second valance body portions provided in a nesting or overlapped heightwise configuration relative each other.

Similar to the embodiment described above with reference to FIGS. 1-5, the disclosed multi-piece construction of the valance body 220 allows the separate body portions 240, 270 to be arranged adjacent to each other when in the disassembled state, thereby permitting the body portions 240, 270 to be nested or otherwise provided in an overlapping heightwise configuration so as to extend across a significantly smaller heightwise distance as compared to the overall height 234 of the assembled valance body 220. As a result, the packaging for the disclosed valance body 220 need only be designed to accommodate the heightwise profile of the body portions 240, 270 when in their nested or overlapped state (as opposed to accommodating the overall height 234 of the valance body 220). For instance, FIG. 12 illustrates an end view of the valance body portions 240, 270 described above with reference to FIGS. 8-11 positioned within the embodiment of the package 301 described above with reference to FIG. 6. As shown, the first and second body portions 240, 270 may be positioned relative to each other within the package 301 such that the body portions 240, 270 substantially overlap, such as by positioning the body portions 240, 270 in a side-by-side nesting configuration within the second storage compartment 317 along the heightwise direction H of the body portions 240, 270. As a result, the heightwise profile of the valance body portions 240, 270, as packaged, may be significantly reduced as compared to the heightwise profile of the assembled valance body 220. Specifically, when in the nested or overlapped state, the body portions 240, 270 may collectively extend across a heightwise distance 325 that is significantly smaller than the overall height 234 of the valance body 220, thereby allowing the body portions 240, 270 to fit within the height constraints of the package 301. As a result, the disclosed valance body portions 240, 270 may be packaged within the second storage compartment 317 without requiring the dimensions of the package 301 to be modified to accommodate the larger overall height 234 of the valance body 220 and without adjusting the orientation of the valance body portions 240, 270 within the package 301, which, as indicated above with reference to FIG. 7, may be desirable for allowing the valance body portions 240, 270 to be cut in package along with the window covering using a cut-down or size-in-store (SIS) machine.

Referring now to FIG. 12, an end view of the first and second body portions 240, 270, as packaged in FIG. 11, is illustrated in accordance with aspects of the present subject matter. As shown, to provide the illustrated nesting or overlapped configuration, the first and second body portions 240, 270 of the valance body 220 may be configured to define complementary or mating surfaces along their front and/or rear sides 246, 248, 276, 278. For instance, the front side 246 of the first body portion 240 may generally define a heightwise shape or profile that is complementary to the heightwise shape or profile defined by the front side 276 of the second body portion 270 such that the first and second body portions 240, 270 are configured to nest substantially flush with each other when the body portions 240, 270 are positioned in the orientation shown in FIG. 12. Specifically, in one embodiment, the front side 246 of the first body portion 240 may define an arcuate or curved profile extending from the first valance end 244 of the first body portion 240 to the front edge 260 of the first body portion 240 that matches or corresponds to the arcuate or curved profile of the front side 276 of the second body portion 270 extending from the second valance end 274 of the second body portion 270 to the joint end 272 of the second body portion 270. As such, when the body portions 240, 270 are nested relative to each other in reverse heightwise orientations such that the joint ends 242, 272 of the body portions 240, 270 are aligned in the cross-wise direction CW of the valance body 220 at one end of the nested assembly and the opposed valance ends 244, 276 of the body portions 240, 270 are aligned in the cross-wise direction CW of the valance body 220 at the other end of the nested assembly, the front sides 246, 276 of the body portions 240, 270 may nest substantially flush together along their corresponding curved profiles. Additionally, as shown in FIG. 12, the second body portion 240 may define a recessed area 294 at its second valance end 274 (i.e., the end that defines the bottom end 228 of the valance body 220) that is configured to receive a corresponding upper lip 266 disposed at the first valance end 244 of the first body portion 240 (i.e., the end that defines the top end 226 of the valance body 220) when the body portions 240, 270 are provided in the nesting configuration.

Figure 14:
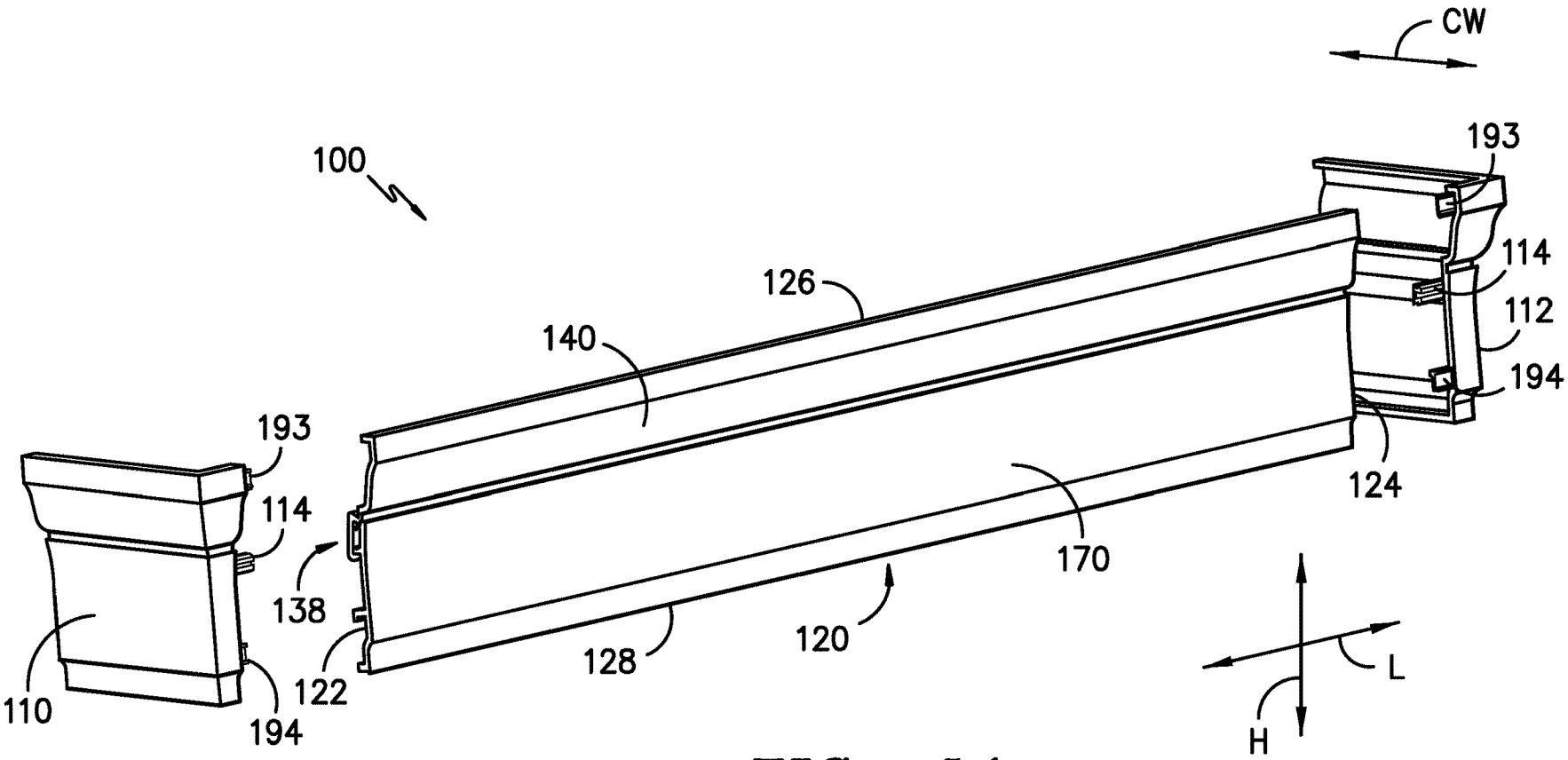
FIG. 14 illustrates a perspective view of a further embodiment of a valance assembly configured to be installed relative to a covering for an architectural structure in accordance with aspects of the present subject matter, particularly illustrating endcaps of the valance assembly exploded away from a corresponding valance body of the valance assembly.
Figure 15:
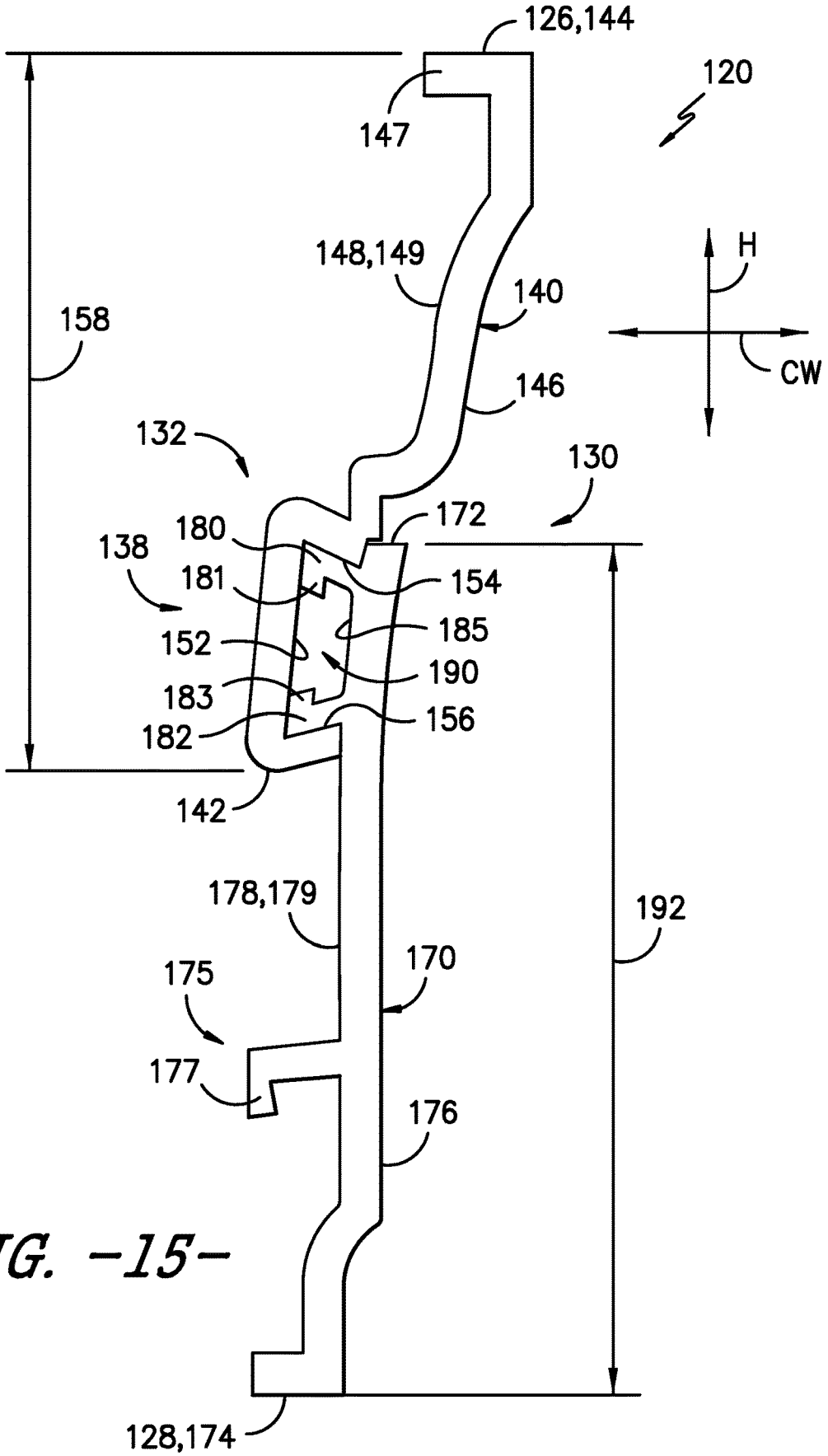
FIG. 15 illustrates an end view of the valance body shown in FIG. 14, particularly illustrating first and second body portions of the valance body assembled together.
Figure 16:
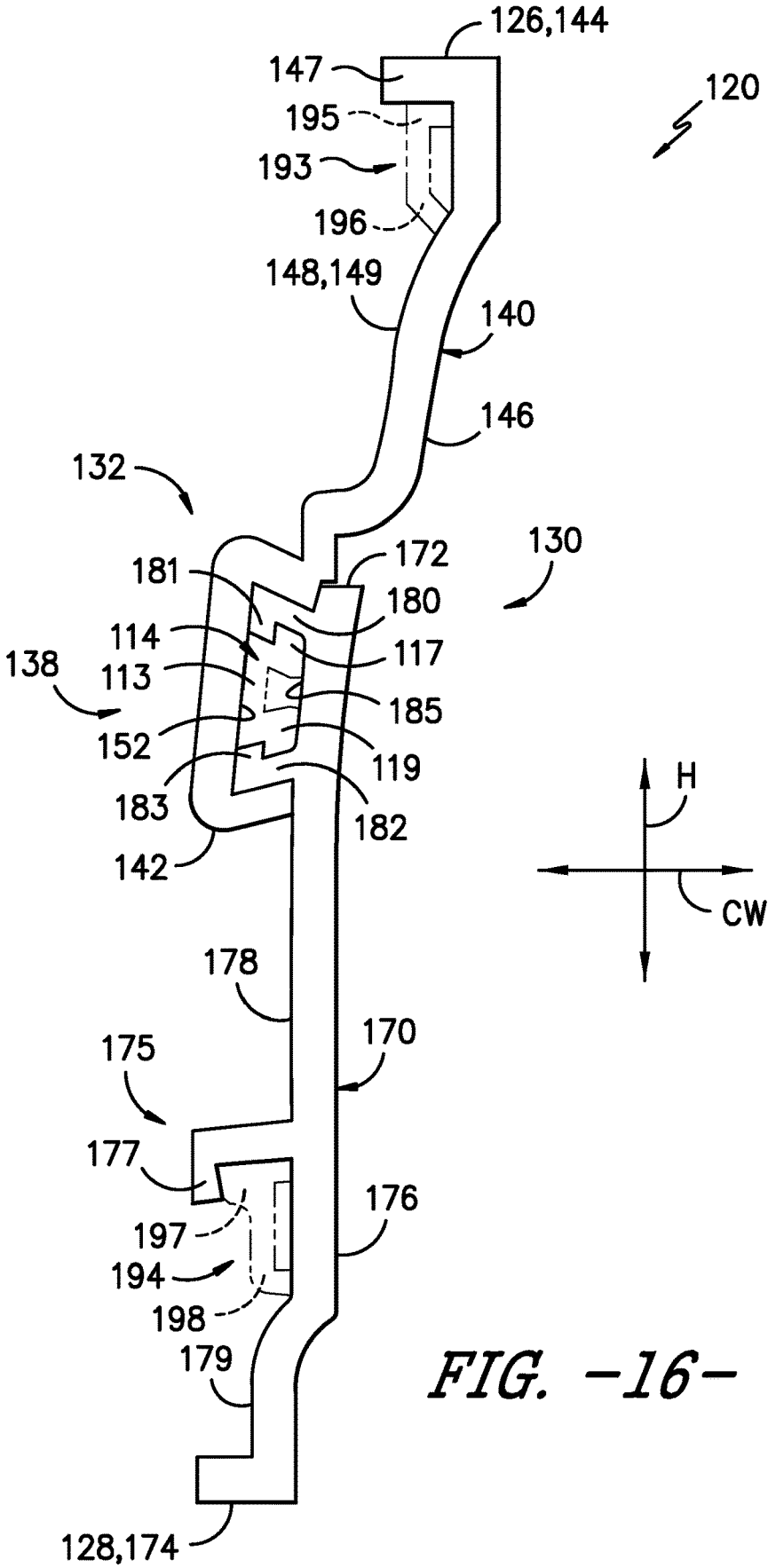
FIG. 16 illustrates another end view of the valance body shown in FIG. 14, particularly illustrating engagement or retention features of one of the endcaps positioned relative to the first and second body portions of the valance body.

Referring now to FIGS. 14-16, several views of a variation of the embodiment of the valance assembly 100 described above with reference to FIGS. 1-5 are illustrated in accordance with aspects of the present subject matter. Specifically, FIG. 14 illustrates a perspective view of the valance assembly 100, with the opposed endcaps 110, 112 of the assembly 100 being exploded away from the valance body 120 of the assembly 100. FIG. 15 illustrates an end view of the assembled valance body 120 shown in FIG. 14. Additionally, FIG. 16 illustrates another assembled end view of the valance body 120 shown in FIG. 15, particularly illustrating the positioning of retention or engagement features of the endcaps 110, 112 relative to the valance body 120 when the valance assembly 100 is in its assembled state. It should be appreciated that, except as otherwise indicated below, the valance assembly 100 shown in FIGS. 14-16 is generally configured the same as the valance assembly 100 described above with reference to FIGS. 1-5. Thus, the same reference characters used within and described above with reference to FIGS. 1-5 will be referenced below and used within FIGS. 14-16 to identify the same or similar components of the valance assembly 100.

As shown in FIG. 14, unlike the embodiment of the valance assembly 100 described above, each endcap 110, 112 includes multiple engagement or retention features, with each feature configured to be received within, engaged against, and/or otherwise positioned adjacent to a corresponding feature or component of the valance body 120 to facilitate coupling the endcaps 110, 112 to the body 120 and/or to facilitate alignment and/or positioning of the endcaps 110, 112 relative to the body 120. Specifically, in addition to the outwardly projecting post 114 described above with reference to FIG. 2, each endcap 110, 112 further includes first and second engagement members 193, 194 configured to extending outwardly therefrom to allow each engagement member 193, 194 to be engaged against or otherwise extend adjacent to a portion of the valance body 120 positioned at each adjacent lateral end 122, 124 of the body 120. For example, as shown in FIG. 14, the first engagement member 193 of each endcap 110, 112 is generally spaced apart in the heightwise direction H from the post 114 (e.g., by being positioned on each endcap 110, 112 above the post 114 in the heightwise direction H) such that the first engagement member 193 is configured to be engaged against or otherwise extend adjacent to a portion of the first valance body portion 140 of the valance body 120, such as at a location between the top end 126 of the valance body 120 and the joint 138 defined between the first and second body portions 140, 170. Similarly, as shown in FIG. 14, the second engagement member 194 of each endcap 110, 112 is generally spaced apart in the heightwise direction H from the post 114 in the opposite direction of the first engagement member 193 (e.g., by being positioned on each endcap 110, 112 below the post 114 in the heightwise direction H) such that the second engagement member 194 is configured to be engaged against or otherwise extend adjacent to a portion of the second valance body portion 170 of the valance body 120, such as at a location between the bottom end 128 of the valance body 120 and the joint 138 defined between the first and second body portions 140, 170.

As particularly shown in FIG. 16, when each endcap 110, 112 is installed relative to the assembled valance body 120, the first and second engagement members 193, 194 (shown in phantom lines in FIG. 16) may be configured to engage or otherwise extend adjacent to corresponding portions or features of the first and second body portions 140, 170, respectively. For example, in the illustrated embodiment, the first engagement member 193 is configured to be positioned relative to the first valance body portion 140 in the assembled state such that an upper portion 195 of the first engagement member 193 contacts or otherwise extends adjacent to a rearward extending flange 147 of the first valance body portion 140 positioned at the top end 126 of the valance body 120. Additionally, a lower portion 196 of the first engagement member 193 may be configured to contact or otherwise extend adjacent to a portion of a rear surface 149 of the first valance body portion 140 defined along its rear side 148 that is spaced apart from the flange 147 in the heightwise direction H. Similarly, as shown in FIG. 16, the second engagement member 194 may configured to be positioned relative to the second valance body portion 170 in the assembled state such that an upper portion 197 of the second engagement member 194 contacts or otherwise extends adjacent to a retention arm 175 extending outwardly from the second valance body portion 170 along its rear side 178. For instance, in the illustrated embodiment, the retention arm 175 corresponds to a hooked member having a hooked portion 177 that extends around and engages the upper portion 197 of the second engagement member 194. Moreover, a lower portion 198 of the second engagement member 194 may be configured to contact or otherwise extend adjacent to a portion of a rear surface 179 of the second valance body portion 170 defined along its rear side 178 that is spaced apart from the retention arm 175 in the heightwise direction H.

Additionally, similar to the embodiment described above, the post 114 of each endcap 110, 112 may be configured to be received within an open volume or cavity 190 defined between the first and second body portions 140, 170 when the body portions 140, 170 are assembled together, with the cavity 190 generally forming an insertion slot for the post 114. As particularly shown in FIG. 15, the cavity 190 may generally extend in the heightwise direction H directly between the first and second angled projections 180, 182 of the second valance body portion 170 and in the cross-wise direction CW between the base slot wall section 152 of the first valance body portion 140 and the opposed surface/wall 185 of the second body portion 170. However, unlike the embodiment described above with reference to FIGS. 3 and 4, the angled projections 180, 182 include hooked ends 181, 183 that extend along the base slot wall section 152 of the first valance body portion 140, thereby providing an additional retention or engagement feature within the cavity 190. Specifically, as shown in FIG. 15, the first angled projection 180 includes a first hooked end 181 extending downwardly along the base slot wall section 152 towards the opposed, second angled projection 182. Similarly, as shown in FIG. 15, the second angled projection 182 includes a second hooked end 183 extending downwardly along the base slot wall section 152 towards the opposed, first angled projection 180.

In such an embodiment, the post 114 of each endcap 110, 112 may be configured to define a shape or profile generally corresponding to the shape or profile of the cavity 190. For instance, as particularly shown in FIG. 16, the post 114 may include a base portion 115 configured to extend within the cavity 190 in the heightwise direction H along the base slot wall section 152 across the space or gap defined directly between the first and second hooked ends 181, 183 of the angled projections 180, 182. Additionally, the post 114 may include opposed, first and second hooked portions 117, 119 extending from the base portion 115, with the first hooked portion 117 being configured to wrap around the first hooked end 181 of the first angled portion 180 and to extend into the crosswise space or gap defined between the first hooked end 181 and the opposed the opposed surface/wall 185 of the second body portion 170 and the second hooked portion 119 being configured to wrap around the second hooked end 183 of the second angled portion 182 and to extend into the crosswise space or gap defined between the second hooked end 183 and the opposed surface/wall 185 of the second body portion 170. As such, the complementary hooked features of the angled projections 180, 182 and the post 114 may serve to provide improved engagement and/or retention between each endcap 110, 112 and the valance body 120 when the components are assembled together to form the valance assembly 100.

Figure 17:
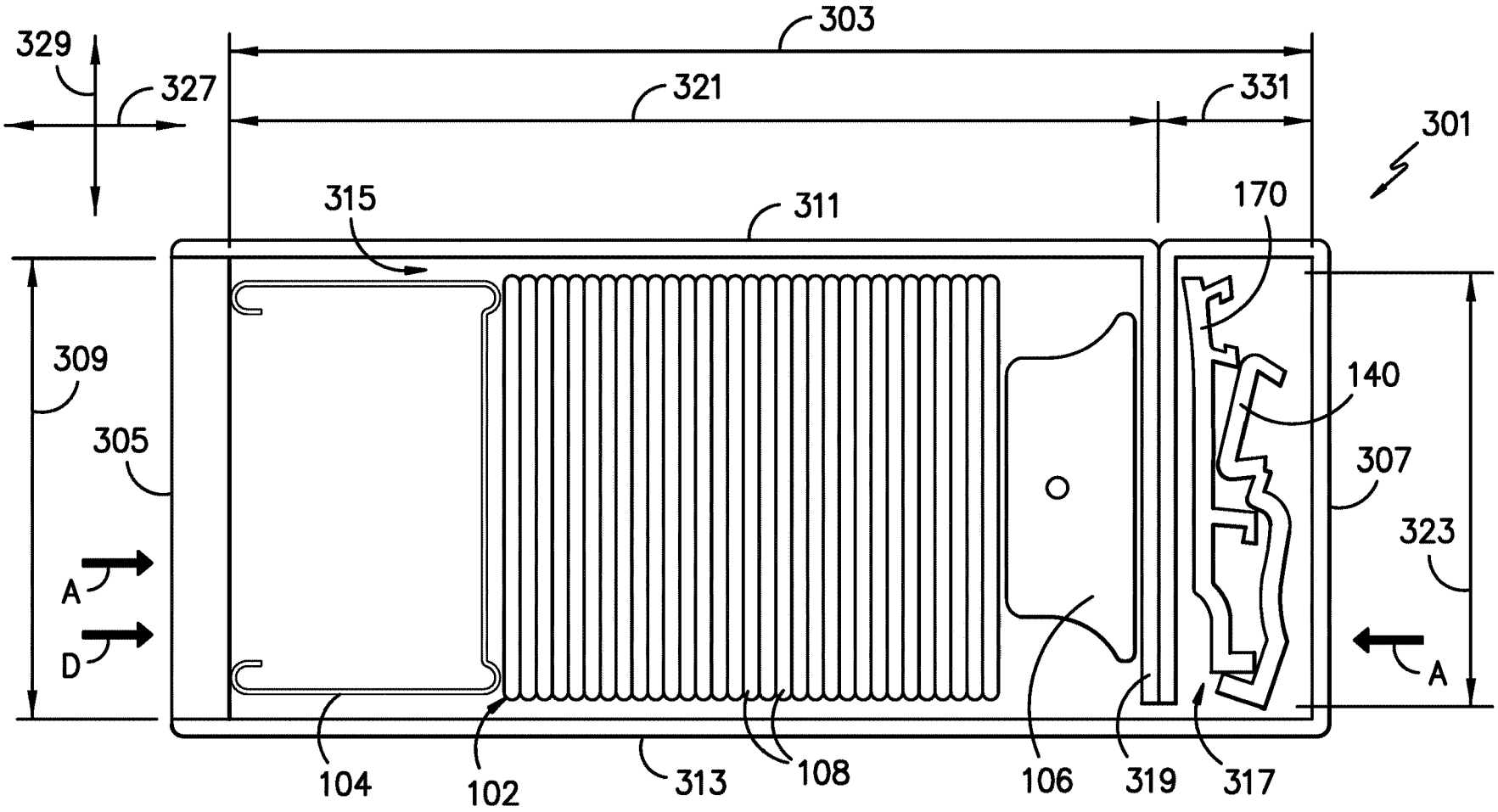
FIG. 17 illustrates an end view of yet another embodiment of the packaged assembly shown in FIG. 6, particularly illustrating the first and second body portions of the valance body shown in FIG. 14 positioned within the package along with the components of the covering shown in FIG. 1.

As indicated above, the specific shape, dimensions and/or general configuration of the valance body portions 140, 170 may be selected to allow the body portions 140, 170 to be nested or otherwise provided in an overlapping heightwise configuration when in a disassembled state, thereby permitting the body portions 140, 170 to be arranged relative to each other in an efficient manner for packaging. For example, in one embodiment, the height 158, 192 of one or both of the valance body portions 140, 170 may be adjusted to facilitate the desired side-by-side nesting configuration for the body portions 140, 170 within the associated packaging. Specifically, in the embodiment shown in FIGS. 14-16, the relative height 158 of the first valance body portion 140 has been reduced as compared to that shown in FIGS. 3 and 4 to achieve a different nesting configuration for the body portions 140, 170. For example, FIG. 17 illustrates the embodiment of the valance body portions 140, 170 shown in FIGS. 14-16 packaged within the embodiment of the package 301 shown in FIG. 6. As shown in FIG. 17, similar to the embodiment described above with reference to FIG. 6, the nested body portions 140, 170 extend across a heightwise distance 325 that is smaller than the overall height 309 of the package 301, thereby allowing the body portions 140, 170 to fit within the height constraints of the package 301. However, due to the different nesting configuration, the nested body portions 140, 170 of FIG. 17 defines a smaller widthwise profile than the nested body portions 140, 170 of FIG. 6, thereby allowing the second storage compartment 317 to define a smaller width 331 in the first packaging direction 327 of the package 301. As such, the overall width 303 of the package 301 may be reduced, which may provide significant advantages when taking into account shipping constraints and/or the amount of shelf space to be occupied by the package 301 within a retail store. Additionally, as described above with reference to FIG. 7, the disclosed packaging configuration for valance body portions 140, 170 may allow such body portions to be 140, 170 cut in the package 301 along with the window covering using a cut-down or size-in-store (SIS) machine.

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, cross-wise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A valance assembly configured to be installed relative to a headrail of a covering for an architectural structure such that said valance assembly extends in a lengthwise direction along a length of the headrail, said valance assembly comprising:

a valance body extending longitudinally in the lengthwise direction between a first lateral end and a second lateral end and in a heightwise direction between a first valance end and a second valance end, said valance body defining an overall height in the heightwise direction between said first and second valance ends, said valance body comprising:

a first valance body portion extending in the lengthwise direction between said first and second lateral ends of said valance body and in the heightwise direction between said first valance end of said valance body and an opposed first joint end, said first valance body portion defining a joint slot at or adjacent to said first joint end; and a second valance body portion extending in the lengthwise direction between said first and second lateral ends of said valance body and in the heightwise direction between said second valance end of said valance body and an opposed second joint end, said second valance body portion including first and second projections at or adjacent to said second joint end that are configured to be received within said joint slot of said first valance body portion, said first and second projections being spaced apart from each other in the heightwise direction such that an insertion slot is defined between said first and second projections; and an endcap configured to be coupled to one of said first lateral end or said second lateral end of said valance body, said endcap including an outwardly extending post;

wherein:

when said first and second valance body portions are assembled relative to each other such that said first and second projections are received within said joint slot, a joint is defined between said first and second valance body portions that extends longitudinally in the lengthwise direction between said first and second lateral ends of said valance body; and said post of said endcap is received within said insertion slot at said joint defined between said first and second valance body portions when said endcap is coupled to said one of said first lateral end or said second lateral end of said valance body.

2. The valance assembly of claim 1, wherein:

said first valance body portion extends in a cross-wise direction perpendicular to the heightwise and lengthwise directions between a first front side and a first rear side; said second valance body portion extends in the cross-wise direction between a second front side and a second rear side; and when said first valance body portion is assembled relative to said second valance body portion, said first and second front sides of said first and second valance body portions together define a front face of said valance body and said first and second rear sides of said first and second valance body portions together define a rear face of said valance body.

3. The valance assembly of claim 1, wherein said joint is configured to substantially constrain relative motion between said first and second joint ends of said first and second valance body portions in both the heightwise direction and a cross-wise direction extending perpendicular to the heightwise and lengthwise directions.

4. The valance assembly of claim 3, wherein said joint is further configured to substantially constrain relative rotational motion between said first and second joint ends of said first and second valance body portions along a rotational axis extending parallel to the lengthwise direction.

5. The valance assembly of claim 1, wherein:

said first valance body portion defines a first height in the heightwise direction between said first valance end of said valance body and said first joint end;

said second valance body portion defines a second height in the heightwise direction between said second valance end of said valance body and said second joint end; and said first and second heights are less than said overall height of said valance body.

6. The valance assembly of claim 5, wherein said overall height of said valance body is less than a summation of said first and second heights.

7. The valance assembly of claim 1, wherein:

an end portion of each of said first and second projections is configured to be received within said joint slot at one of said first lateral end or said second lateral end of said valance body; and said first and second valance body portions are configured to be moved relative to one another in the lengthwise direction such that a relative position of said end portions of said first and second projections are moved within said joint slot towards the other of said first lateral end or said second lateral end of said valance body.

8. The valance assembly of claim 1, wherein:

said joint slot is defined by first and second angled wall sections of said first valance body portion that extend outwardly from a base wall section of said joint slot; and said first and second angled wall sections are angled towards each other such that said joint slot defines a converging profile as said joint slot extends outwardly from said base wall section.

9. The valance assembly of claim 8, wherein said first and second projections comprise first and second angled projections, respectively, defining a complementary profile to said joint slot such that said first and second projects extend adjacent to said first and second angled wall sections, respectively, when said at least one angled projection is received within said joint slot.

10. The valance assembly of claim 9, wherein:

an outer surface of said first angled projection defines a first diverging profile that is complementary to the converging profile of said joint slot such that said first angled projection extends adjacent to said first angled wall section when said first angled projection is received within said joint slot; and an outer surface of said second angled projection defines a second diverging profile that is complementary to the converging profile of said joint slot such that said second angled projection extends adjacent to said second angled wall section when said second angled projection is received within said joint slot.

11. The valance assembly of claim 1, wherein said first and second valance body portions define complementary heightwise profiles such that said first and second valance body portions are configured to nest relative to each other when said valance body is disassembled and said complementary heightwise profiles are positioned adjacent to each other.

12. The valance assembly of claim 1, wherein:

said endcap comprises a first endcap configured to be coupled to said first lateral end of said valence body; and the valance assembly further comprises a second endcap configured to be coupled said second lateral end of said valance body;

said second endcap includes an outwardly extending second post; and said second post of said second endcap is received within said insertion slot at said joint defined between said first and second valance body portions when said second endcap is coupled to said second lateral end of said valance body.

13. The valance assembly of claim 1, wherein a shape of said post of said endcap is complementary to a shape of said insertion slot.

14. The valance assembly of claim 1, wherein:

said endcap further comprises first and second engagement members spaced apart from said post in the heightwise direction;

said first engagement member is configured to extend adjacent to a portion of the first valance body portion when said endcap is coupled to said one of said first lateral end or said second lateral end of said valance body; and said second engagement member is configured to extend adjacent to a portion of the second valance body portion when said endcap is coupled to said one of said first lateral end or said second lateral end of said valance body.

15. The valance assembly of claim 1, wherein at least one of said first engagement member or said second engagement member of said endcap is configured to extend adjacent to a hooked portion or flanged portion of said valance body.

16. The valance assembly of claim 2, wherein said post is configured to extend within said insertion slot in the heightwise direction between said first and second projections of said second valance body portion and in the crosswise direction between a base slot wall section of the first valance body portion defining a portion of the joint slot and an opposed surface of said second valance body portion extending between said first and second projections.

17. A valance assembly configured to be installed relative to a headrail of a covering for an architectural structure such that said valance assembly extends in a lengthwise direction along a length of the headrail, said valance assembly comprising:

a valance body extending longitudinally in the lengthwise direction between a first lateral end and a second lateral end and in a heightwise direction between a top end and a bottom end, said valance body comprising:

a first valance body portion extending in the lengthwise direction between said first and second lateral ends of said valance body and in the heightwise direction between said top end of said valance body and an opposed first joint end, said first valance body portion defining a first height in the heightwise direction and further defining a joint slot at or adjacent to said first joint end; and a second valance body portion extending in the lengthwise direction between said first and second lateral ends of said valance body and in the heightwise direction between said bottom end of said valance body and an opposed second joint end, said second valance body portion defining a second height in the heightwise direction, said second valance body portion including first and second projections at or adjacent to said second joint end that are configured to be received within said joint slot of said first valance body portion, said first and second projections being spaced apart from each other in the heightwise direction such that an insertion slot is defined between said first and second projections; and an endcap configured to be coupled to one of said first lateral end or said second lateral end of said valance body, said endcap including an outwardly extending post;

wherein;

when said first and second projections are received within said joint slot to form a joint between said first and second valance body portions, said valance body defines an overall height in the heightwise direction between said top and bottom ends that is greater than said individual first and second heights of said first and second valance body portions; and said post of said endcap is received within said insertion slot when said endcap is coupled to said one of said first lateral end or said second lateral end of said valance body.

18. The valance assembly of claim 17, wherein:

said endcap comprises a first endcap configured to be coupled to said first lateral end of said valence body; and the valance assembly further comprises a second endcap configured to be coupled said second lateral end of said valance body;

said second endcap includes an outwardly extending second post; and said second post of said second endcap is received within said insertion slot at said joint defined between said first and second valance body portions when said second endcap is coupled to said second lateral end of said valance body.

19. The valance assembly of claim 17, wherein a shape of said post of said endcap defines is complementary to a shape of said insertion slot.

20. The valance assembly of claim 17, wherein:

said endcap further comprises first and second engagement members spaced apart from said post in the heightwise direction;

said first engagement member is configured to extend adjacent to a portion of the first valance body portion when said endcap is coupled to said one of said first lateral end or said second lateral end of said valance body; and said second engagement member is configured to extend adjacent to a portion of the second valance body portion when said endcap is coupled to said one of said first lateral end or said second lateral end of said valance body.

21. The valance assembly of claim 17, wherein said joint is configured to substantially constrain relative motion between said first and second joint ends of said first and second valance body portions in both the heightwise direction and a cross-wise direction extending perpendicular to the heightwise and lengthwise directions.

* * * * *